United States Patent [19]

Brumberger et al.

[11] 3,963,201

[45] June 15, 1976

[54] SEQUENTIAL OCCUPANCY RELEASE CONTROL METHOD AND APPARATUS FOR TRAIN VEHICLES

[75] Inventors: Neil A. Brumberger, Pittsburgh; Bennie C. Auxer, Trafford; Donald L. Rush, Pittsburgh, all of Pa.

[73] Assignee: Westinghouse Electric Corporation, Pittsburgh, Pa.

[22] Filed: Mar. 3, 1975

[21] Appl. No.: 554,781

[52] U.S. Cl. ..... 246/34 R; 246/187 B

[51] Int. Cl.[2] ..... B61L 21/06

[58] Field of Search..... 246/77, 34 R, 34 CT, 246/167 R, 187 C, 187 B, 28 R, 122 R; 235/150.2, 150.24; 303/21 CG, 21 EB

[56] References Cited

UNITED STATES PATENTS

| | | | |
|---|---|---|---|
| 3,886,515 | 5/1975 | Cottin | 235/150.2 |
| 3,887,152 | 6/1975 | Eblovi | 246/34 R |
| 3,891,167 | 6/1975 | Perry | 246/34 R |

*Primary Examiner*—Trygve M. Blix

*Assistant Examiner*—Reinhard J. Eisenzopf

*Attorney, Agent, or Firm*—R. G. Brodahl

[57] ABSTRACT

An improved train vehicle speed control system is provided for operation in conjunction with train vehicle occupancy control signals and train occupancy indication signals in relation to a train vehicle track system including a plurality of predetermined track circuit signal blocks through which the train vehicles pass. It is desired that control of train vehicle speed be provided in relation to the detected occupancy by the train vehicle in a particular signal block, for maintaining train vehicle occupancy protection requirements and providing protection signals to establish desired sequential occupancy control of the train vehicles through each of selected signal blocks adjacent to that particular signal block. Spurious pseudo vehicle occupancy in any signal block is detected and included in the provided train speed control in relation to that signal block. The provided train vehicle occupancy control signal is determined in relation to the provided occupancy indication signal, predetermined protection signals and the unique features of the signal block in which train vehicle occupancy is detected.

20 Claims, 33 Drawing Figures

SEQUENTIAL OCCUPANCY RELEASE CONTROL METHOD AND APPARATUS FOR TRAIN VEHICLES

CROSS REFERENCE TO RELATED APPLICATION

The present application is related to a concurrently filed patent application Ser. No. 554,783 filed Mar. 3, 1975 by R. E. Perry et al and entitled SEQUENTIAL OCCUPANCY RELEASE CONTROL METHOD AND APPARATUS FOR TRAIN VEHICLES, assigned to the same assignee as the present application, and the disclosure of that related patent application is hereby incorporated by reference into the present application.

BACKGROUND OF THE INVENTION

It is known in the prior art to control the movement of one or more vehicles coupled together to form a train through a fixed block track circuit signaling system. Specific signal blocks of track are established by predetermined low impedance electrical signal boundaries at the ends of each signal block. When a train vehicle is present in a given signal block, at least one vehicle axle of the train electrically shorts between the two conductive track rails on which the vehicle runs. A signal transmitter is coupled to the track at one end of each signal block and a cooperative signal receiver is coupled to the track at the opposite end of that same signal block, for providing desired control of the train movement and detecting the occupancy of a train vehicle within that signal block. The train position is detected electrically as the individual vehicles of the train move along the track rails, passing through succeeding blocks, as described in U.S. Pat. No. R.E. 27,472 of G. M. Thornebooth and as described in an article published in the Westinghouse Engineer for September 1972 at pages 145 to 151.

The vehicle detection equipment is located at the wayside of the track, and when a vehicle is detected in a given signal block, a control signal is provided to influence the speed code of the next previous block and if desired this control signal can ripple back to one or more previous signal blocks. Under certain abnormal operational conditions such as when electric power to the train vehicle is lost or when a corrosion film or ice builds up on the top of the track rails, there is a small possibility that the conventional signaling system may not detect a train vehicle within a present signal block. The conventional signaling system detects the train vehicle shunt impedance, and if this is abnormally high for some reason the train vehicle occupancy detection becomes difficult. An excessive corrosion film will increase the train vehicle shunt impedance by forming a barrier layer to make more difficult the detection of train vehicle occupancy.

The need for sensing train vehicle presence in a given signal block has led to occupancy detection and sequential occupancy release control of train movement, such that when a vehicle occupancy is detected in a given signal block it is necessary to subsequently detect occupancy in the next succeeding signal block before a release is desired of the occupancy behind the vehicle. The occupancy in a previous signal block is retained and not released until the train vehicle is positively detected in the next signal block.

In conventional wayside train control systems the detection of train movement is primarily a passive operation. Every effort is made to insure the reliable and consistent detection of train positions under the widest possible range of conditions. Typical railroad interlocking procedures rarely employ any means of retaining or latching the last known position of a train. One prior art solution to this problem has been the check-in and check-out principle whereby the presence of a train once detected in a given track circuit block is remembered until the same train is detected in the next adjacent track circuit block. This sequential release of last occupancies when accomplished by means of hardwired logic systems has proved to be complex and cumbersome. In addition consideration should be given to traffic direction, switch position, gate status, block lengths and station and system boundary conditions, all of which are unique to each individual track circuit signal block, such that the amount of customized hardware circuitry necessary to accomplish the above train control arrangement can be rather expensive.

An article in Business Week for Mar. 2, 1974 at page 51, discusses a control system for providing occupancy detection and sequential occupancy release control of train vehicle movement for a transit system. In relation to successive signal blocks N−2, N−1, N, N+1 and N+2 and so forth, the following train movement control algorithms can be utilized:

$$Q_N = SQ_N = Q_{N-1} \,|\, \overline{Q}_{N+1} \cdot I_{N+1} \,(\overline{B}_{N+1} + \overline{Q}_{N+2} \cdot I_{N+2} \,(\overline{B}_{N+2} + \text{etc.} \quad (1)$$

$$\overline{Q}_N = RQ_N = Q_{N+1} \quad (2)$$

$$B_N = SB_N = I_N \cdot \overline{Q}_N \cdot \overline{Q}_{N-1} \,|\, \overline{Q}_{N-2} \,(\overline{B}_{N-1} + \overline{Q}_{N-3} \,(\overline{B}_{N-2} + \text{etc.} \quad (3)$$

$$\overline{B}_N = RB_N = \overline{I}_N \quad (4)$$

$$O_N = SO_N = I_N + Q_N \quad (5)$$

where $I_N$ is the primary train vehicle occupancy indication signal for signal block N, $Q_N$ is the backup protection signal for block N, $B_N$ is the false or pseudo occupancy indication signal for signal block N and $O_N$ is the occupancy control signal for signal block N as seen by the primary train protection system. The $O_N$ signal controls the movement of a subsequent train vehicle when a train vehicle is detected within a given signal block N. The above equations (1) to (5) are operative with well known AND and OR logic relationships as indicated where the system is implemented in positive logic. The train control system is operative such that when the occupancy control signal $O_N$ is false this is applied to the previous signal block N−1 for permitting the normal speed code signal to be provided in signal block N−1 in relation to a train moving through block N−1, and indicates there is no train vehicle in signal block N to interfere with the movement of the train in the signal block N−1.

The occupancy control signal $O_N$ is set false when the occupancy indication signal $I_N$ for block N is false to indicate no train occupies signal block N and the backup protection signal $Q_N$ is false which indicates no previous train is present in signal block N and the next adjacent signal blocks in a forward direction of signal block N to interfere with the movement of a train within controlled signal block N−1. The above set $Q_N$ (Equation 1) is operative to set the backup protection signal $Q_N$ true when the signal $Q_{N-1}$ is true and the protection signal $Q_{N-1}$ is false and the occupancy indication signal $I_{N+1}$ is true and the signal false or pseudo occupancy $B_{N+1}$ is false, or the above set $Q_N$ (Equation 1) is operative to set the backup protection signal $Q_N$ true when the signal $Q_{N-1}$ is true and the backup protection signal $Q_{N+2}$ is false and the occupancy indication signal $I_{N+2}$ is true and the false or pseudo occupancy signal $B_{N+2}$ is true and so forth for all of the remaining track signal blocks within the Q line protection arrangement including signal block N up to a theoretical infinite number of signal blocks. The above reset $Q_N$ or $(\overline{Q}_N)$ provided by above Equation (2) is operative to reset the backup protection signal $Q_N$ to false when the backup protection signal $Q_{N+1}$ is true. The above set $B_N$ (Equation 3) is operative to set the false or pseudo occupancy signal $B_N$ to true when the occupancy indication signal $I_N$ is true and the backup protection signal $Q_N$ is false and the backup protection signal $Q_{N+1}$ is false and the backup protection signal $Q_{N+2}$ is false and the false or pseudo occupancy signal $B_{N+1}$ is false or when the occupancy indication signal $I_N$ is true and the backup protection signal $Q_N$ is false and the backup protection signal $Q_{N+1}$ is false and the backup protection signal $Q_{N+3}$ is false and the false occupancy signal $B_{N+2}$ is false, or and so forth as indicated by above Equation (3), for all of the remaining track signal blocks going backward from signal block N up to a theoretical infinite number of signal blocks. The reset $B_N$ (Equation 4) is operative to reset the false occupancy signal $B_N$ to false when the occupancy indication signal $I_N$ is false.

The above occupancy control signal $O_N$ (Equation 5) is operative with well known OR logic relationships to set the occupancy control signal $O_N$ to true when the occupancy indication signal $I_N$ is true or the backup protection signal $Q_N$ is true.

SUMMARY OF THE PRESENT INVENTION

In accordance with the present invention, a sequential occupancy release control method and apparatus for train vehicles is provided having an improved operation for protecting against loss of signal block vehicle occupancy detection and for protecting a given train of vehicles in relation to a subsequent train of vehicles as well as in relation to predetermined activities such as track switch operations involving that given train of vehicles.

The train vehicle protection relationships in accordance with the present invention have been improved. The reset of the protection signal $Q_N$ is now determined as follows:

$$RQ_N = \overline{Q}_{N-1} \cdot Q_{N+1} \ldots Q_{N+X} \quad (6)$$

where X has a value such that the known total length of the track circuit signal blocks N, N+1, up to . . . N+X is selected to be greater than the predetermined maximum length of a train. The occupancy control signal $O_N$ is now determined as follows:

$$O_N = I_N + Q_N + Q_{N-1} + S_N \quad (7)$$

where $S_N$ is an occupancy protection signal which does not have the attribute of a Q signal of forcing protection in a forward direction as does the signal $Q_{N-1}$ in the equation. The set of the false or pseudo occupancy signal $B_N$ is now determined as follows:

$$SB_N = I_N \cdot \overline{Q}_N \cdot \overline{Q}_{N-1} \cdot \overline{S}_N \quad (8)$$

DETAILED DESCRIPTION OF THE PRESENT INVENTION

Figure 1:
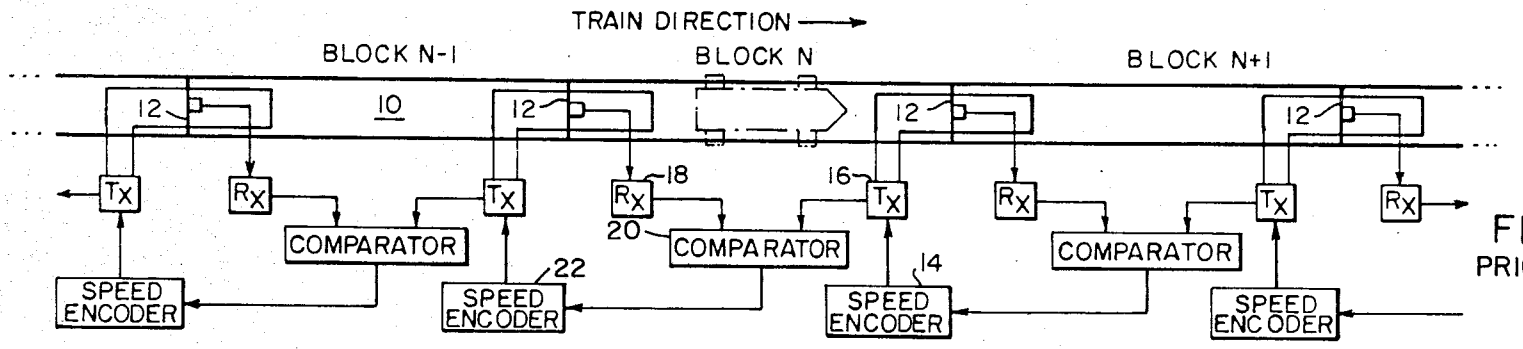
FIG. 1 PRIOR ART
FIG. 1 is a schematic showing of the prior art train control system including track circuit signal blocks operative for failsafe sensing of the occupancy of a train vehicle.

In FIG. 1 there is shown a train control system including a track 10 provided with electrically conducting short circuit members 12 for dividing the track 10 into a plurality of successive signal blocks such as N−1, N and N+1. Normal speed command signals from a speed encoder 14 are supplied to a transmitter 16 coupled to the signal block N such that a receiver 18 is operative to receive the speed command signal when a train vehicle is not present within signal block N and such that the receiver 18 does not receive the speed command signal when the train vehicle 17 is present within track signal block N and provides an electrical short circuit to prevent the transmitted speed command signal from the transmitter 16 from passing through the block N to the receiver 18, such as known in the prior art and described in above referenced U.S. Pat. No. RE 27,472. A comparator 20 is operative to compare the signal transmitted by the transmitter 16 with the signal received by the receiver 18 for determining the presence of the train vehicle 17, and when the receiver 18 does not receive the transmitted signal from the transmitter 16, the comparator provides an occupancy indication signal to the speed encoder 22 operative with the previous track signal block N−1 for preventing other than a zero speed code signal being supplied to the block N−1 when the block N is occupied by the train vehicle 17. In this respect the operation is such that the occupancy indication signal supplied by the comparator is true when the train vehicle 17 is not present within the block N and is false when the train vehicle 17 is present within the block N such that a false control signal from the comparator 20 to the speed encoder 22 provides a zero speed signal to the previous signal block N−1 to prevent the passage of any subsequent train vehicle through the block N−1 and into the block N in order to insure that a collision does not occur between the subsequent train vehicle and the protected vehicle 17 presently illustrated in signal block N.

Figure 2A:
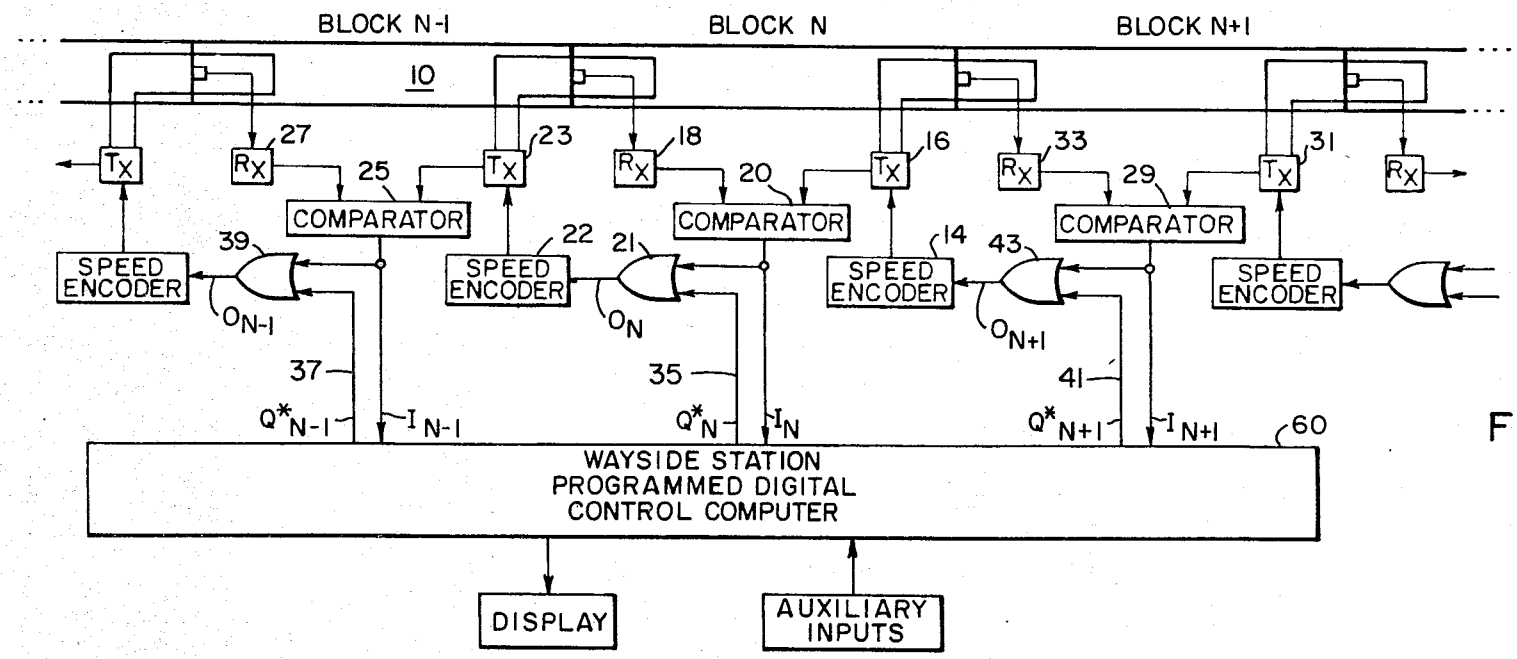
FIG. 2A is a schematic showing of the present train vehicle control system including a sequential occupancy control of a train of vehicles passing through each of successive track circuit signal blocks for the example of a positive logic implementation.

In FIG. 2A there is shown the present train control system including the sequential occupancy control of a train of vehicles passing through each of successive signal blocks N−1, N and N+1. There is provided for each of these signal blocks a speed encoder, a transmitter and a receiver such as described in relation to FIG. 1. In addition a comparator 20 is shown operative in relation to signal block N to compare the transmitted speed code signal from the transmitter with the received speed code signal from the receiver for providing a detected occupancy indication signal $I_N$ which is applied through gate 21 to a speed encoder 22 operative with the previous signal block N−1, for controlling the operation of the transmitter 23 operative with the signal block N−1. A wayside station programmed digital control computer 60 is operative with each of a predetermined number of track circuit signal blocks making up that wayside station, and includes a software control program operative to provide a desired sequential occupancy release control of train vehicles passing along the track 10. An illustrative control program listing for this purpose is included with the above related patent application.

The comparator 20 is operative with the transmitter 16 and receiver 18 of signal block N to provide a zero value or false occupancy indication signal $I_N$ to the control computer 60 when the presence of a train vehicle within the signal block N is detected. Similarly the comparator 25 is operative with the transmitter 23 and receiver 27 of signal block N−1 for providing a false occupancy indication signal $I_{N-1}$ to the control computer 60 when a train vehicle is detected within the signal block N−1. The comparator 29 is operative with the transmitter 31 and the receiver 33 for providing a false occupancy indication signal $I_{N+1}$ to the control computer 60 when the occupancy of a train vehicle is detected within the signal block $N_+$1. The control computer 60 is operative to provide the backup protection signal $Q_N$ in relation to the signal block N over the conductor 35 operative with the gate 21. The control computer 60 is operative to provide the backup protection signal $Q_{N-1}$ over the conductor 37 to the gate 39 when the set Q equation is satisfied in relation to the train movement through the signal block N−1. The control computer 60 is operative to supply the backup protection signal $Q_{N+1}$ over the conductor 41 to the OR gate 43 when the set Q equation provides such a signal. The operation of the gate 21 operative with the signal block N is such that if anyone of the occupancy indication signal $I_N$ or the backup protection signal $Q_N$ should indicate a vehicle occupancy condition, then the enabling false output signal from the gate 21 is removed such that the speed encoder 22 provides a zero speed signal to the previous block N−1 for protecting a train vehicle occupying the signal block N.

Figure 2B:
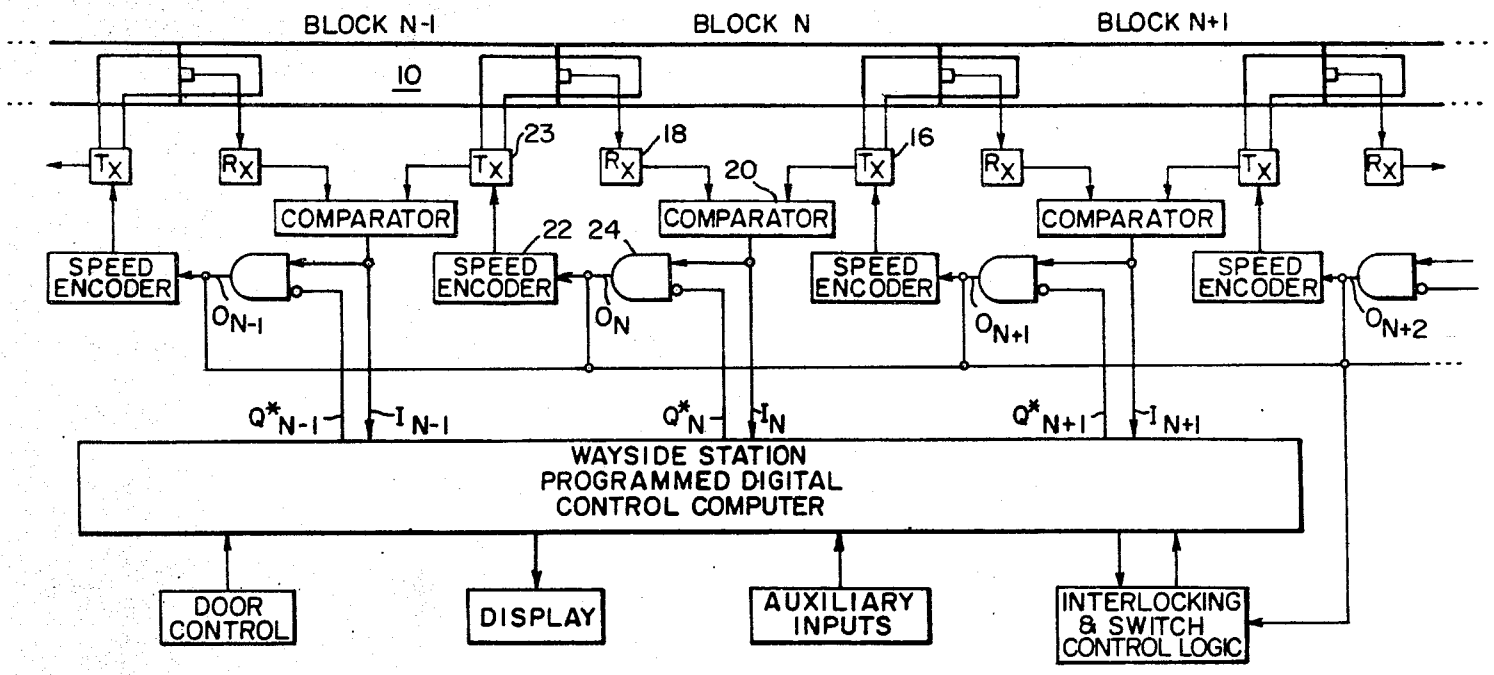
FIG. 2B is a schematic showing of the present train vehicle control system including a sequential occupancy control of a train of vehicles passing through each of successive track circuit signal blocks for the example of a negative logic implementation.

In FIG. 2B there is a schematic showing of the present train vehicle control system including a sequential occupancy control of a train of vehicles passing through each of successive track circuit signal blocks for the example of a negative logic implementation of the provided train vehicle control equations, such that Equation (5) then becomes $O_N = I_N \cdot \overline{Q}_N$, with $I_N$ indicating an occupancy when false, and $O_N$ provided by AND gate 24 when true enables a normal speed code to be transmitted in relation to the previous signal block N−1 as determined by the speed encoder 22 operative with the transmitter 23.

Figure 3A:
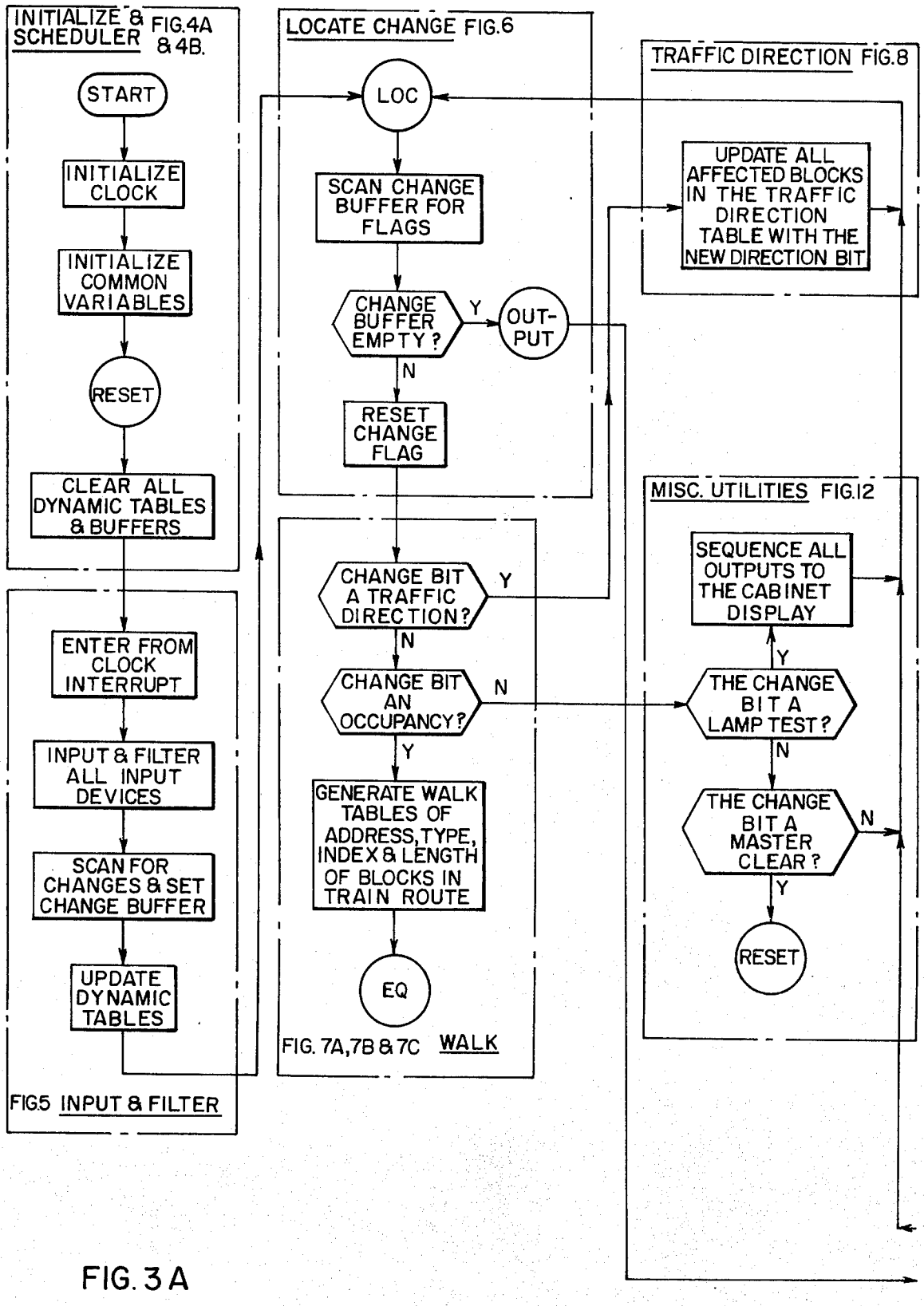
FIGS. 3A and 3B are a system flow chart illustrating the logic operations in accordance with the present invention for the train control system shown in FIG. 2.
Figure 3B:
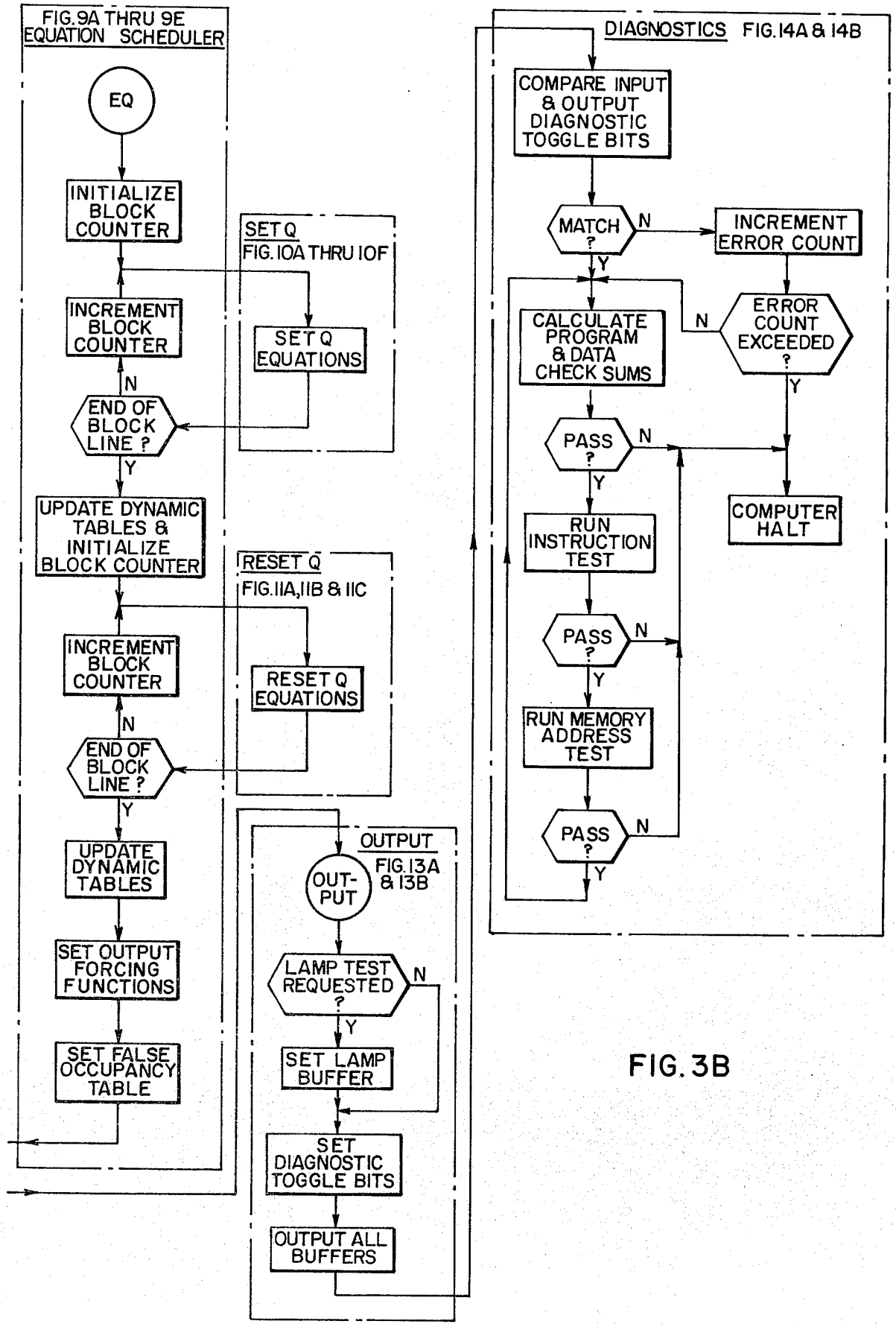
Figure 4A:
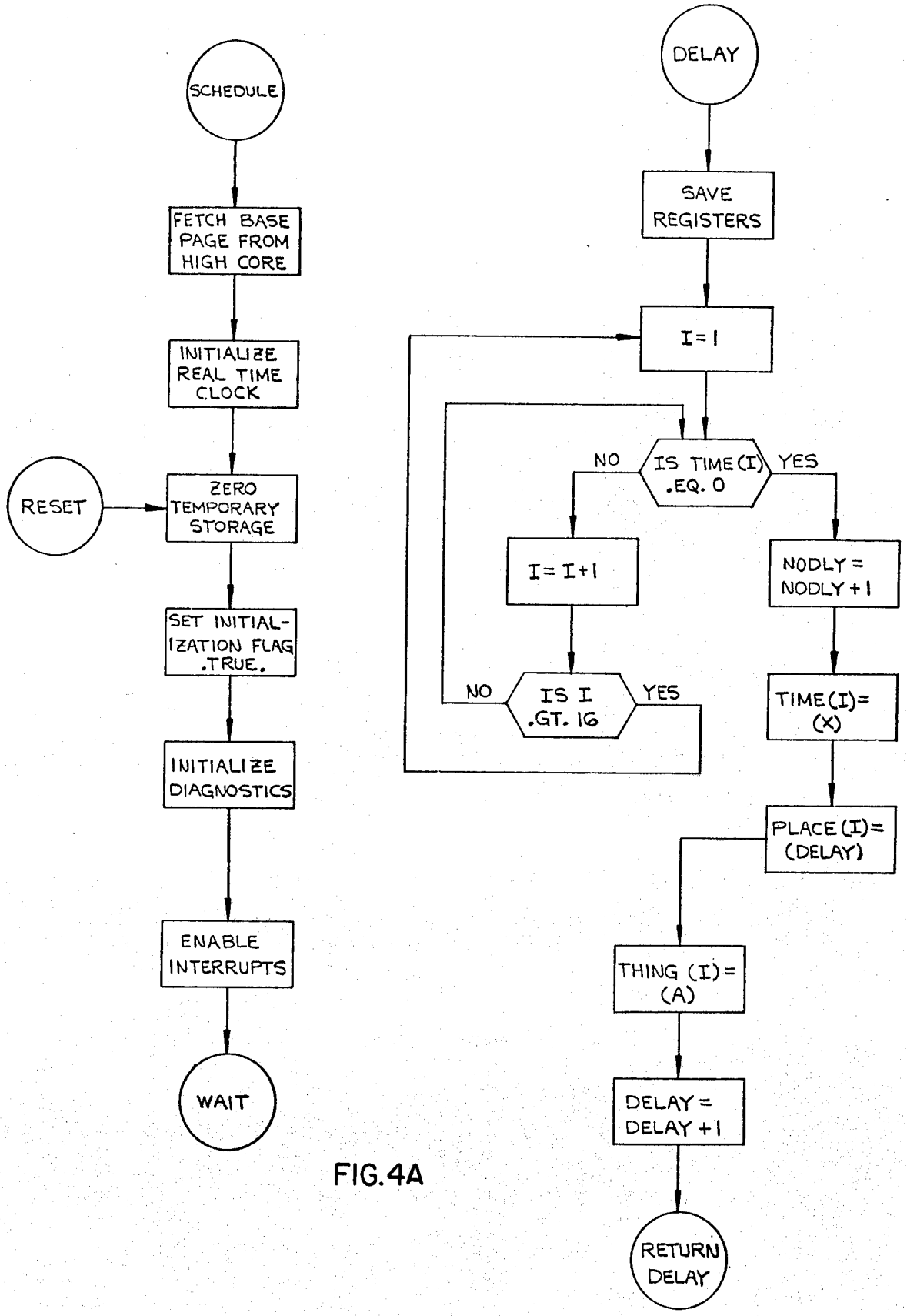
FIGS. 4A and 4B are a flow chart illustrating the logic operation of the SCHEDULER routine.

The scheduler routine, shown in FIG. 3A in general, and in greater detail in FIG. 4, operates to initialize temporary storage and setting of flags to initialize diagnostics, enable interrupts and then waits for a 0.4 second interrupt from the clock. At the end of each 0.4 second time interval, an interrupt is received, the registers are saved, reinitialization of the real time clock occurs and a counter is looked at to see if in the meantime any program has requested that some event occur at the expiration of a time delay. If it has, then a table that has previously been set up of time delay values is searched and all the time values in it are decremented. If any of the time delay values goes to zero, the appropriate program is entered to process the time delay event. Any routine in the system can call and enter this program at the entry point delay shown in FIG. 4A which puts into memory arrays the address to which a return is desired at the end of the predetermined time delay. By calling DELAY, any program can be called back at any number of intervals of 0.4 second each later. When it is determined that there are no more expired time delays, a flag is interrogated to see if processing is complete. Since it is possible for such an abundance of events to happen in one cycle that complete processing of all those events cannot take place, a flag will be set and at the occurrence of the next 0.4 second clock pulse and rather than start at the beginning of processing, control will be maintained in the program at whatever point it currently exists in order to complete the processing of the previous cycle. If and when previous processing is complete, a new iteration through the program is begun.

Figure 5:
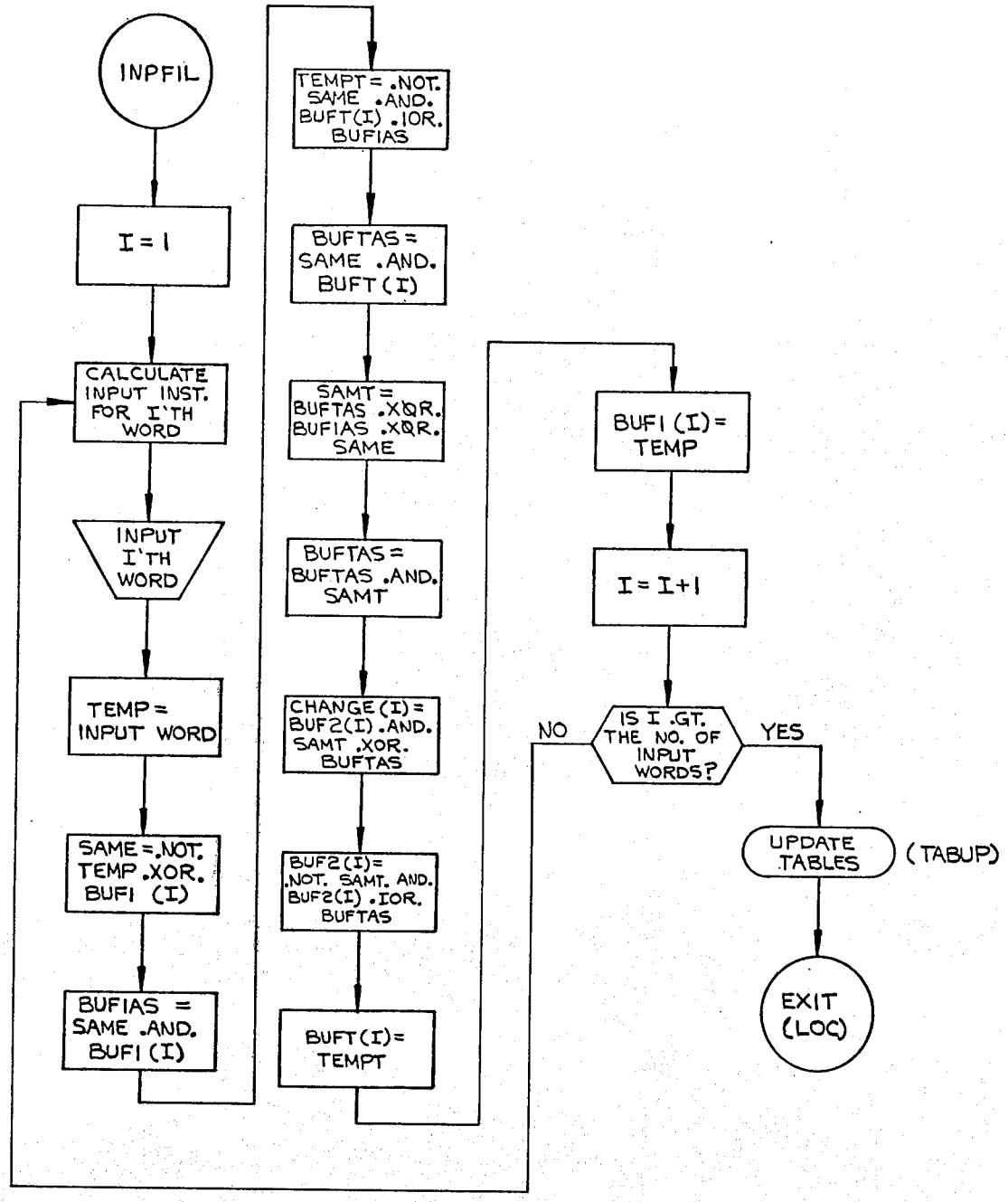
FIG. 5 is a flow chart illustrating the logic operation of the INPUT AND FILTER routine.

After the clock pulse the first routine to operate is the input and filter routine INPFIL shown in general in FIG. 3A and shown in greater detail in FIG. 5. The routine includes four buffers, namely an input buffer, an intermediate buffer, a final buffer and a change buffer. Data is read from the various station inputs and placed into the input buffer. Through analysis of the contents of all the buffers, a determination is made whether a change has existed on that input for a minimum of two cycles of 0.8 second. If so, an appropriate bit is set in the change buffer to mark that event for further processing. The flow chart shown in FIG. 5 is operative for this purpose. The index (I) to the buffers is set to one. The input instruction is calculated for the $I^{th}$ word. The $I^{th}$ word is input and the word is stored in a temporary location. The value of these bits is analyzed with respect to the status of the buffers to see whether a change exists in the input in relation to the first buffer and whether this change is continuous throughout the buffers such that it should be marked for processing or whether a change that was processing through the buffers has disappeared and should no longer continue to process through the buffers. In general the input is examined in respect to the first buffer to find any changes that have occurred, and the intermediate buffer is examined with respect to those changes to see if those changes still exist in that buffer, and then the final buffer is examined with respect to those changes to see if they have propagated all the way through the buffers. At the conclusion of this operation the change buffer is set if a change has propagated through all the buffers. The new status of all buffers is updated as per the current input, then the word counter is incremented and the process is repeated until all inputs have been examined. The backup protection signal Q, the occupancy indication I and the false or pseudo occupancy signal B tables are updated in core memory via the subroutine TABUP.

Figure 6:
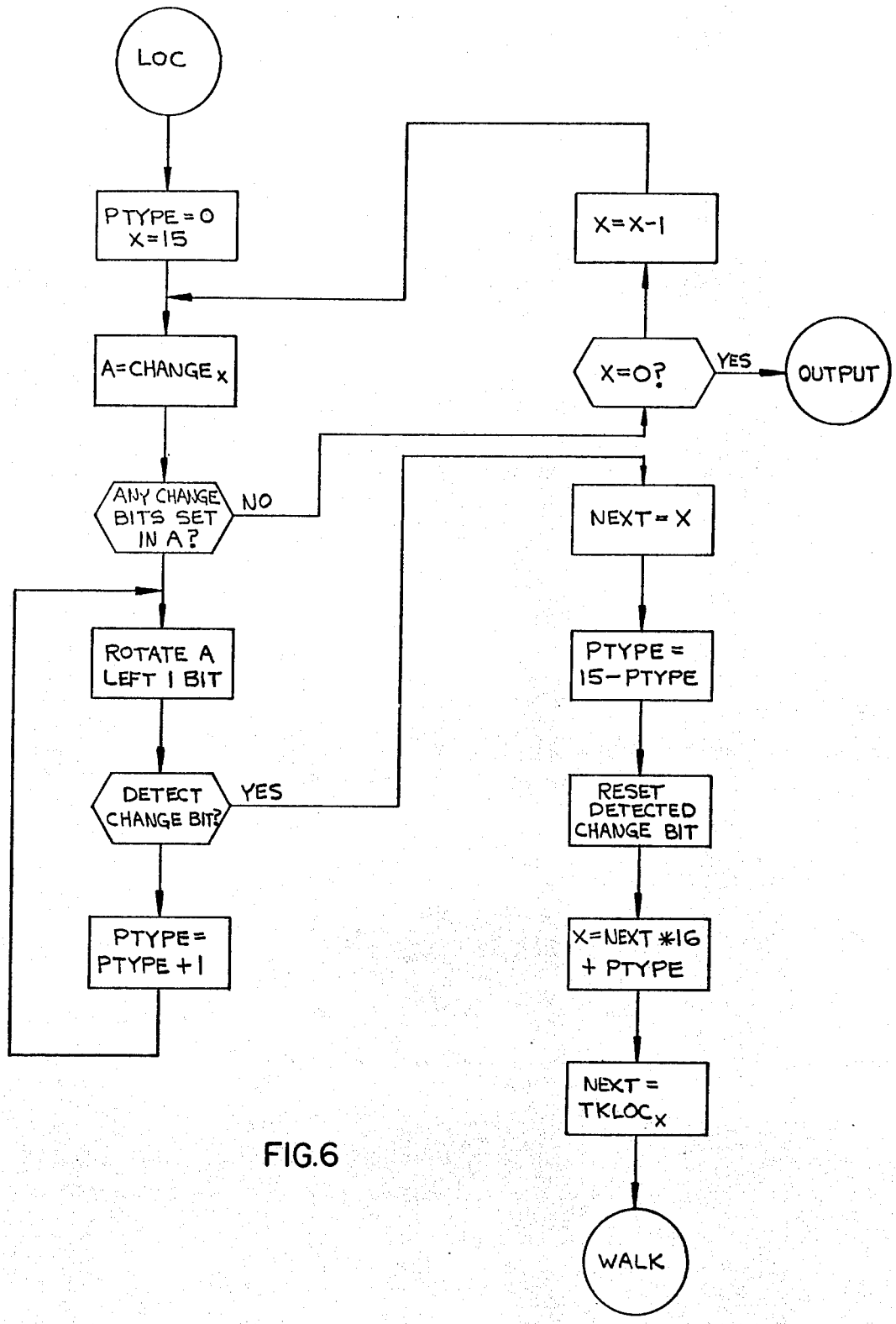
FIG. 6 is a flow chart illustrating the operation of the LOCATE CHANGE routine.

The LOC routine shown in greater detail in FIG. 6, then runs to locate changes. It searches the change buffer and sets an index to the change buffer which is incremented through the change buffer looking for non-zero words. If a non-zero word is found, the LOC routine calculates the bit number in that word which is non-zero and then goes to the WALK routine, shown in greater detail in FIG. 7, passing along the word bit index of the input which has changed. The LOC routine is re-entered every time completion of processing of a bit occurs until there are no more bits left in the change buffer, at which time processing goes to the output routine, shown in greater detail in FIG. 11.

If a change is detected in the LOC routine, the index location of the change bit is calculated and that information is passed to the WALK routine. The WALK routine goes to a software track plan and the nature of the event change is interrogated to see when processing should take place. Each bit has a block of information associated with it in the track plan to identify what type of bit it is.

The main body of the track plan, several examples of which are illustrated in the disclosure of the above related patent application, is composed of a series of data blocks, usually of from 1 to 4 words long. At least one data block is necessary to define each input bit to the system. The first word in each data block defines the type of input bit being described. Bits 8-F of the first word of each data block are encoded into 1 to 24 possible types. These types are listed below.

| Type | Definition |
|---|---|
| 00 | Standard Occupancy |
| 01 | Condition Block |
| 02 | Station Platform |
| 03 | Station Boundary −1 |
| 04 | Merge Forward |
| 05 | Merge Reverse |
| 86 | Station Exit Forward |
| 87 | Station Exit Reverse |
| 88 | Overlap Occupancy Forward |
| 89 | Overlap Occupancy Reverse |
| 8A | Transfer Track Forward |
| 8B | Transfer Track Reverse |
| 8C | Terminal Zone Forward |
| 8D | Terminal Zone Reverse |
| 8E | Gate Block Forward |
| 8F | Gate Block Reverse |
| 10 | Station Platform Door Open |
| 11 | Traffic Direction |
| 12 | TMZ Stop |

-continued

| Type | Definition |
|---|---|
| 13 | Master Clear |
| 14 | Lamp Test |
| 15 | Diagnostic Toggle Bit |
| 16 | Switch Position |
| 17 | Gate Status |

The exact definition and implementation of each block type will be individually discussed. From the above list, however, several general observations may be made. All input bits that describe a track circuit signal block occupancy have Bit C set to zero, and all non-occupancy types have Bit C set to one. All boundary blocks (i.e., station exit, transfer track, etc.) have Bit F set to a one. Not shown in the above list is the assignments of Bits D and E. Because of the nature of interlockings, special timing was necessary in the resetting of Q's around an interlocking. For this purpose Bits D and E are used. Their implementation is described later.

STANDARD OCCUPANCY

A typical data block for a standard track circuit or signal block is shown below. Beside it is a diagram of each byte of information for a Type O data block.

| | | STANDARD OCCUPANCY | |
|---|---|---|---|
| Data:003 | Word 1 | Type | Indication Word Bit |
| Data:3A00 | Word 2 | Block Length | 0 0 |
| Data:0402 | Word 3 | Direction Normal Next Block High Byte | Direction Reverse Next Block Low Byte |

The type as shown above is a standard occupancy type 00 and is in the high-byte of Word 1 of the block. The low byte of Word 1 is the relative bit position in the input buffer of the input bit for the respective track circuit. In this case, the occupancy input for the track circuit is Word 0, Bit 3 of BUF 2. Because the relative position of all track circuit information is preserved in all bit tables, Word 0, Bit 3 is also the assignment in the Q table, B table, Direction table, etc. Also, relative position 03 is the location of the index in TKLOC.

Word 2 of the data block contains the block length. The high byte is the hexadecimal conversion of 1/10 the actual track circuit length in feet. Thus, this track circuit is 579 feet long, and 579/10 = 58 = 3A in base 16. If this dimension is desired in meters, the equivalency relationship would be 1 meter equals 3.281 feet.

For a standard track circuit with no switch, the low byte of Word 2 must be zero.

Word 3 of the data block contains the relative index addresses in TKLOC of the track circuits adjacent to this track circuit in the forward and reverse directions. The adjacent track circuits in the forward and reverse directions occupy the relative positions in TKLOC of 04 and 02, respectively.

The data block for a track circuit with a switch is a simple extension of the above arrangement. The data block and description for such a track circuit is shown below.

| | STANDARD OCCUPANCY | |
|---|---|---|
| Data:0006 | Type | Indication |
| Data:092C | 0 0 | Word Bit |
| Data:0705 | Block Length | Switch Position |
| Data:0710 | | Word Bit |
| | Switch | Normal |
| | Forward | Reverse |
| | Next Block | Next Block |
| | Switch | Reverse |
| | Forward | Reverse |
| | Next Block | Next Block |

Word one is as described above, listing the type and indication address of the input bit and the high byte of Word 2 contains the coded track circuit length. Since this is a switch block, the length of the track circuit might be different when the switch is in the normal and reverse position. For S.O.R., the shorter of the two choices is always used.

The relative address in the input buffer of the switch position bit is shown in the low byte of Word 2, and the index addresses of the adjacent blocks for switch position normal and reverse are in Words 3 and 4, respectively. As shown above, the switch position bit for Switch 23 is Word 2, Bit C in the input buffer. For switch 23 normal, the forward adjacent block is at index address 07 and the reverse adjacent block is at index address 05. With switch 23 reverse, the forward adjacent block is still at index address 07 and the reverse adjacent block is at index address 10.

CONDITION BLOCK

The type 1 block is a condition block. This data block is actually a dummy block used to handle complex conditions such as a track circuit with several switches. Following is a typical example which has two switches, 23 and 27.

| | | CONDITION BLOCK | |
|---|---|---|---|
| IMR12B | Data:011F | Type | Indication |
| | Data:0035 | 0 1 | Word Bit |
| | Data:1E20 | | Condition |
| | Data:1312 | 0 0 | Word Bit |
| | | Direction A | Direction B |
| EXT7R | Data:001F | | |
| | | Word Bit | Word Bit |
| | Data:1A35 | | |
| | | Extension | Extension |
| | Data:201E | | |
| | | Block A | Block B |
| | Data:291E | | |
| EXT7N | Data:001F | | |
| | Data:1A2C | | |
| | Data:201E | | |
| | Data:2028 | | |

The type 1 block indicates to the program that more information is needed to process the track circuit, and provides a means of accessing that information through extension data blocks. Word 1 of the type 1 block is coded as usual. The low byte of Word 2 contains the relative word/bit position in the input buffer of the condition bit to be checked. In this case, it is switch 27 whose input address is Word 3, Bit 5. Word 3 of the data block contains two direction bit indexes. This is provided because sometimes the traffic direction in a track circuit must be deduced from external conditions. If the condition bit (input Word 3, Bit 5 in this case) is a one, the direction of traffic in the track circuit indexed by the high byte of Word 3 is imposed on the current track circuit. If the condition bit is a zero, the low byte of Word 3 is the index pointer used. In this example, if switch 27 is reverse, the traffic direction in track circuit which is at 1E in TKLOC is written into the MR12B location in the direction table. Likewise, if switch 27 is normal, the direction in MR13B is used.

Word 4 of the data for the type 1 block contains the index addresses of the extension blocks. If the condition bit indexed in Word 2 is a 1, extension block A is used, and if the condition bit is a zero, extension block B is used. Both pointers are relative index addresses in TKLOC of the respective extension blocks. In this case, the pointers are 13 and 12 which reference EXT7R and EXT7N, respectively. Note that in this case, EXT7R and EXT7N are standard occupancies of type 00. EXT7R describes 1MR12B with 23 normal and EXT7N describes MR12B with 27 normal. In a particularly complex track circuit, one type 1 data block could reference another type 1 which could do the same until all conditions (switches, direction bits, TMZ stop signals, etc.) have been checked.

STATION PLATFORM

The station platform data block is similar to a standard type 0 occupancy with one addition. The relative address of TKLOC of the respective station platform door open bit is coded in the low byte of Word 2.

| | | STATION PLATFORM | |
|---|---|---|---|
| IML14A | Data:0202 | Type | Indication |
| | Data:4632 | 0 2 | Word Bit |
| | Data:0301 | Block Length | Door Open |
| | | | Word Bit |
| | | Forward | Reverse |
| | | Next Block | Next Block |

The above data describes ML14A, which is a station platform block. In this case, Door Open No. 1 for ML14A is input Word 3, Bit 2.

STATION BOUNDARY - 1

Because of the special equations used, the track circuit adjacent to the last track circuit at a station boundary is given a unique type.

| | | STATION BOUNDARY — 1 | |
|---|---|---|---|
| IML15A | Data:0301 | Type | Indication |
| | Data:4600 | 0 3 | Word Bit |
| | Data:0200 | Block Length | |
| | | | 0 0 |
| | | Forward | Reverse |
| | | Next Block | Next Block |

As can be seen above, no other special information is required other than the type 3.

MERGE BLOCK

Block Types 4 and 5 describe the merge blocks. These block types are the first that are direction dependent. All block types from Type 4 through Type F are direction dependent. Bit 8 of Word 1 of these types define the direction. A merge block is the track circuit adjacent to a switch block where a normal flow of traffic will merge into a new line.

| MERGE FORWARD | | MERGE REVERSE | |
|---|---|---|---|
| Type | Indication | Type | Indication |
| 0 4 | Word Bit | 0 5 | Word Bit |

-continued

| MERGE FORWARD | | MERGE REVERSE | |
|---|---|---|---|
| Block Length | | Block Length | |
| | 0 0 | | 0 0 |
| Forward Next Block | Reverse Next Block | Forward Next Block | Reverse Next Block |

STATION EXIT BLOCKS

Types 86 and 87 describe station exit blocks. A station exit block is the last track circuit in a given station before entering the next S.O.R. station area. As with merge blocks,

| STATION EXIT FORWARD | | STATION EXIT REVERSE | |
|---|---|---|---|
| Type 8 6 | Indication Word Bit | Type 8 7 | Indication Word Bit |
| Block Length | | Block Length | |
| | 0 0 | | 0 0 |
| Forward Next Block | Reverse Next Block | Forward Next Block | Reverse Next Block |

the station exit blocks are direction dependent. A station exit forward type describes the last track circuit occupied when travelling out of a station in the forward direction. Conversely, a station exit reverse is the last track circuit out of a station in the reverse direction. Since the last track circuit in a station is considered a boundary, Bit F in the type is set to 1.

OVERLAP OCCUPANCIES

Occupancy information for blocks outside a given station area are input as overlap occupancies. An overlap occupancy is the "OR'ed" occupancy status of the 2 or 3 track circuits outside and adjacent to a station exit block. Like the station exit blocks, overlap occupancies are direction dependent. An overlap occupancy forward (Type 88) is adjacent to a station exit forward and an overlap occupancy reverse (Type 89) is adjacent to a station exit reverse block. Overlap occupancies are considered boundary blocks. Bit F of the type is a 1 and an FF is placed in the appropriate next block pointer location.

| OVERLAP OCCUPANCY FORWARD | | OVERLAP OCCUPANCY REVERSE | |
|---|---|---|---|
| Type 8 8 | Indication Word Bit | Type 8 9 | Indication Word Bit |
| 0 0 | 0 0 | 0 0 | 0 0 |
| Forward F F | Reverse Next Block | Forward Next Block | Reverse F F |

TRANSFER TRACKS

The system exits are treated similar to station exits. A transfer track forward block implies exiting the system in the forward direction, and entering the system in the reverse direction. Since transfer track blocks are boundaries, bit F of the type is a 1 and an FF is placed in the appropriate next block pointer.

| TRANSFER TRACK FORWARD | | TRANSFER TRACK REVERSE | |
|---|---|---|---|
| Type 8 A | Indication Word Bit | Type 8 B | Indication Word Bit |
| Block Length | | Block Length | |
| | 0 0 | | 0 0 |

-continued

| TRANSFER TRACK FORWARD | | TRANSFER TRACK REVERSE | |
|---|---|---|---|
| Forward F F | Reverse Next Block | Forward Next Block | Reverse F F |

TERMINAL ZONES

The terminal zones are block types C and D. The system will presently allow for only one-sided turnbacks (i.e., a train may not enter a TMZ from either end and execute a turnback). The convention of directions is such that a terminal zone forward accepts trains entering in the forward direction and dispatches them in reverse. A terminal reverse zone would, of course, do the opposite.

| TERMINAL ZONE FORWARD | | TERMINAL ZONE REVERSE | |
|---|---|---|---|
| Type 0 C | Indication Word Bit | Type 0 D | Indication Word Bit |
| Block Length | TMZ Stop Word Bit | Block Length | TMZ Stop Word Bit |
| Forward Next Block | Reverse Next Block | Forward Next Block | Reverse Next Block |

The TMZ stop signal is necessary to inform the program whether or not a turnback move is actually in progress. The relative word/bit position in the input buffer of the signal is in the low byte of Word 2 of the data block.

GATE BLOCKS

In turnback moves, it is necessary to establish a two-way boundary to protect traffic adjacent to the terminal zone from losing its protection. This is accomplished with gate blocks. The block is similar to a terminal zone, with only the type changed. A gate block forward is the last track circuit occupied before crossing into or out of the rear end of a terminal zone in the forward direction.

| GATE BLOCK FORWARD | | GATE BLOCK REVERSE | |
|---|---|---|---|
| Type 8 E | Indication Word Bit | Type 8 F | Indication Word Bit |
| Block Length | TMZ Stop Word Bit | Block Length | TMZ Stop Word Bit |
| Forward Next Block | Reverse Next Block | Forward Next Block | Reverse Next Block |

DOOR OPEN INDICATION

To minimize the effect on headways, the system monitors the status of all station platform doors.

| | | DOOR OPEN | |
|---|---|---|---|
| DOOR 01 | Data:1032 | Type | Indication |
| | Data:0002 | | |
| | | 1 0 | Word Bit Station Block |
| | | 0 0 | Word Bit |

In this case, the Door Open bit is in input Word 3, Bit 2 and the accompanying track circuit is ML14A (input Word 0, Bit 2).

TRAFFIC DIRECTION

Each direction bit affects a certain segment of track. This segment may or may not be continuous. The traffic direction data block is set up to tell the control program all the track circuits affected by the respective input bit. The length of the direction type data block is open ended. A zero defines the last word in the data block. The area of track affected by a given data block is first broken down into as many continuous sections of track as necessary. A continuous section of track follows in a forward direction from track circuit to track circuit, taking no turnouts. Should a traffic bit encompass a switch, the first continuous section of track would follow as if the switch were in the normal position. To include a section of track adjoining the turnout position of a switch, a new first-block/last-block data word is used.

In the following example word 1 contains the type and indication address as usual. Word 2 contains the relative index address of the first and last blocks of one continuous section of track affected by TZB. Relative location 06 is the address of track circuit ML10A. Travelling in a forward direction, and passing switch 23 in the normal position, the last track circuit in the line affected is TYA (address 2A). Notice that the overlap occupancy indication is included in the affected area. Since track circuit C1 is affected by TZB, but is not a continuous part of the first track segment, it is included as a second segment in data word 3 (10 to 10). Data word 4 is a zero, and ends the block. A continuous track section may not contain a type 01 condition block. If such a block is embedded in a section, the data must be broken up into two sections, neither one containing the type 01 block.

| | | TRAFFIC DIRECTION | |
|---|---|---|---|
| NORTZB | Data:112F | Type | Indication |
| | Data:062A | | |
| | Data:1010 | 1 1 | Word Bit |
| | Data:0000 | | |
| | | First Block | Last Block |
| NORTZS | Data:1177 | | |
| | Data:2223 | Word Bit | Word Bit |
| | Data:1919 | | |
| | Data:0000 | First Block | Last Block |
| | | Word Bit | Word Bit |
| | | One Blank word | |
| | | 0 0 | 0 0 |

BLOCK TYPES 12 THROUGH 17

The remaining block types require only one word each. The type and relative input address are listed for each one as shown.

| TMZ STOP | | DIAGNOSTIC TOGGLE BIT | |
|---|---|---|---|
| Type | Indication | Type | Indication |
| 1 2 | Word Bit | 1 5 | Word Bit |
| **MASTER CLEAR** | | **SWITCH POSITION** | |
| Type | Indication | Type | Indication |
| 1 3 | Word Bit | 1 6 | Word Bit |
| **LAMP TEST** | | **GATE STATUS** | |
| Type | Indication | Type | Indication |
| 1 4 | Word Bit | 1 7 | Word Bit |

Figure 7A:
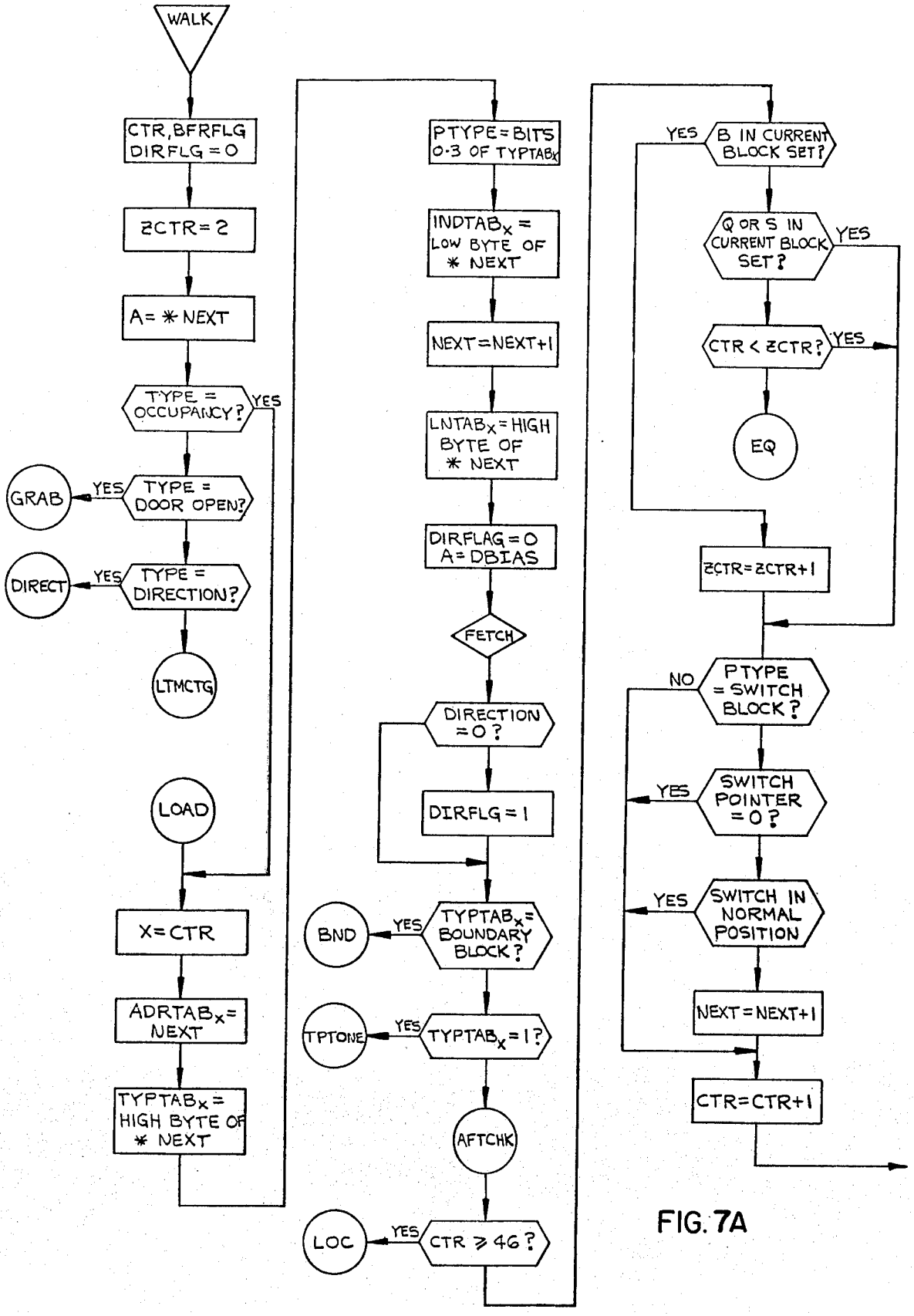
FIGS. 7A, 7B and 7C are a flow chart illustrating the logic operation of the WALK routine.
Figure 7B:
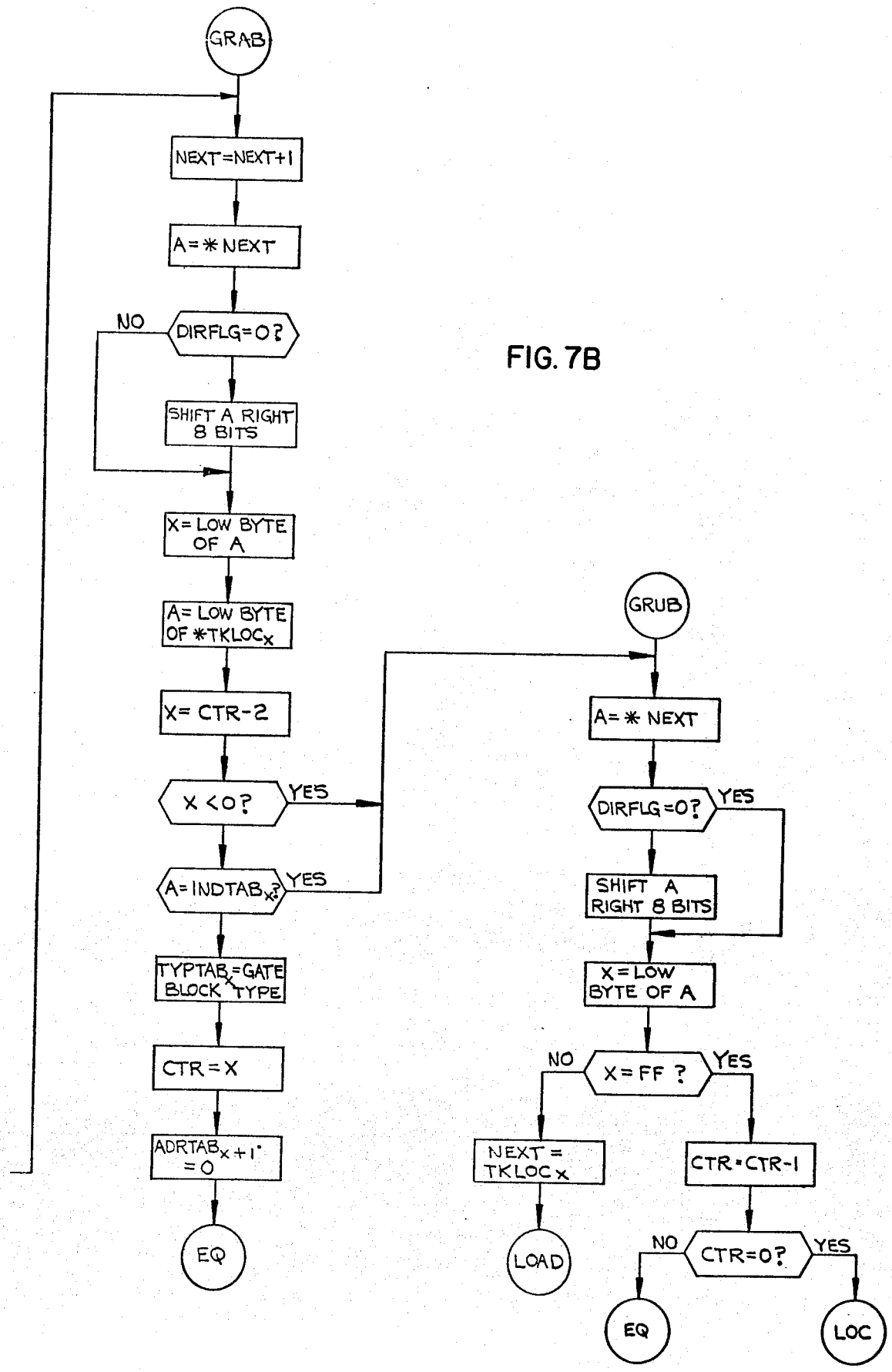
Figure 7C:
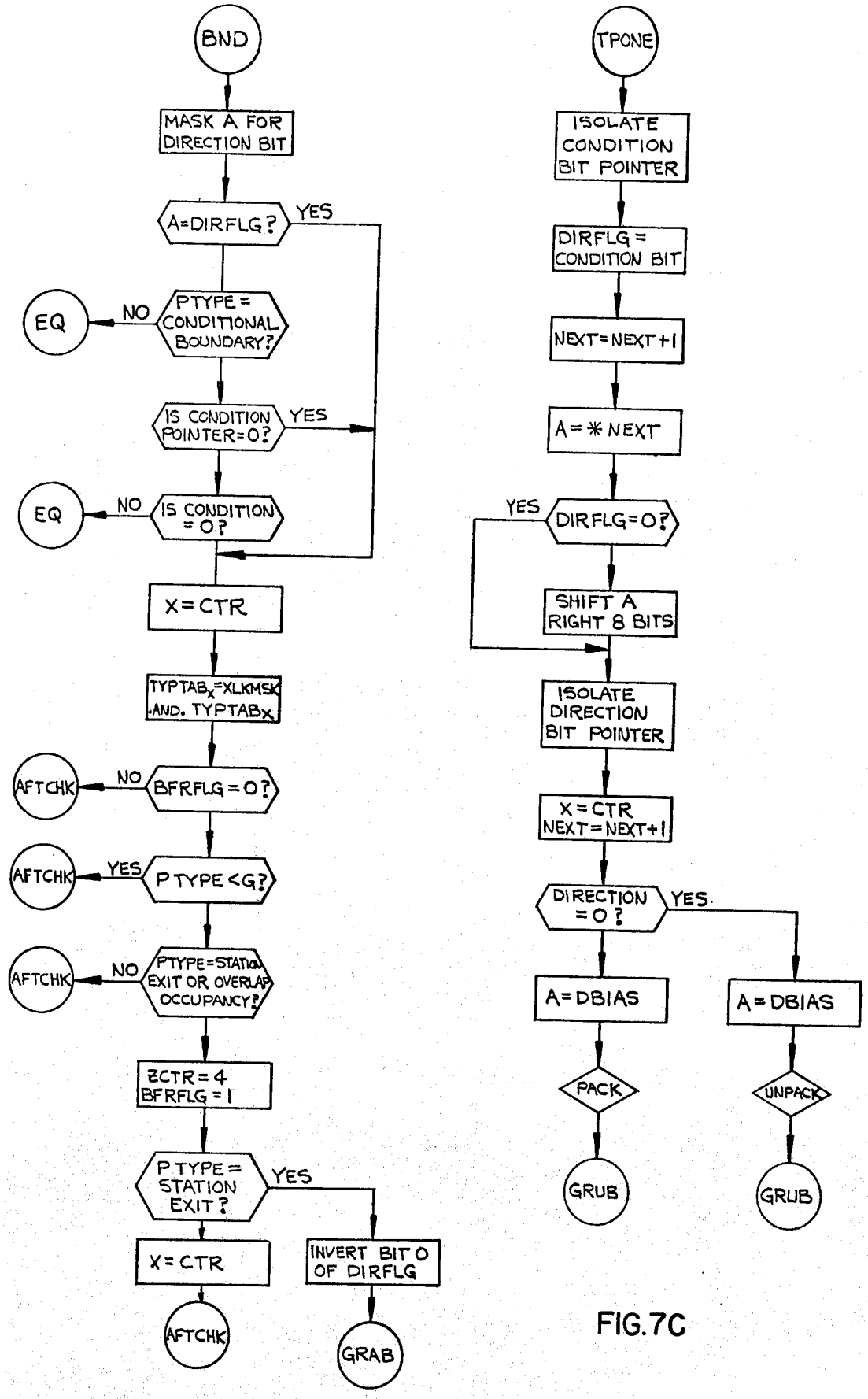

The WALK program, shown in FIGS. 7A, 7B, and 7C, accesses this information and a series of counters are initialized. The location next has in it the address of the bit that changed and the location is accessed, and a check is made to see if that bit is an occupancy bit associated with an occupancy indication signal I. If so, a branch is made to LOAD, if not, the WALK routine determines if that bit is a door open bit and if so a branch is made to GRAB. If not the WALK routine determines if that bit is a direction bit and if so a branch is made to DIRECT shown in FIG. 8. Each signal block has a train traffic direction assigned to it, the WALK routine has to know which way the train movement is to go, and this can become complex when switches and turnouts or the like are involved. When an occupancy indication signal I is received from any given signal block, to determine where the train is and the direction it is going, it is necessary that the train direction associated with that block as well as the directions respectively assigned to the adjacent signal blocks be known, such that proper control of train movement in relation to that signal block can be provided. This is done by updating a table of one bit for each track circuit, with a zero being the convention for forward direction and a one being the convention for reverse direction. An address in the data table for each block specified the next block forward and the next block reverse.

When a bit changes and the LOC routine transfers control to the WALK routine, the WALK determines that bit is an occupancy bit, then the mainbody of the WALK routine is followed. At any given time the status of the track system switch positions, door openings and so forth is changing such that at anytime an occupancy is detected relating to a train movement it is unlikely that since the last time the system was looked at each train and all conditions have remained static, so each time an event change takes place the program looks at all relevant input bits and determines what the route of the train must have been to get the train where it now is in relation to switch positions, turnback signals direction bits, door opens and so forth. In doing so the WALK routine arranges all of the inputs in the four tables upon which all the logic operations in accordance with the equations and special exceptions can operate. These four tables are the block address table ADRTAB, the block index table INDTAB, the block type table TYPTAB and the block length table LNTAB. These tables provide information for the equation implementation part of the control program.

The WALK routine determines from a detected event change input that a train vehicle occupies a present track signal block, and the WALK routine looks at the track block and finds the desired train direction associated with that present track block. The WALK routine then determines the processing of all trailing information starting at the front of the train and extending past the rear of the set of track circuits currently associated, and which information consists of the occupancy indication I signals, all of the backup protection Q signals and all of the occupancy control 0 signals as well as the false or pseudo occupancy B signals. It does so by making the address of that present occurrence signal block as the first entry in the table ADRTAB, it makes the index address of the input and output bits for that present signal block the first entry in the table INDTAB. The WALK routine then takes the present block length in feet and makes it the first entry in the table LNTAB, and makes the type associated to that present signal block such as turnback station platform merge, transfer track and so forth, the first entry in the table TYPTAB. Then the WALK routine looks at the train direction associated with that present signal to establish the next previous signal block going backwards from which the train should have moved into the present signal block. The software track plan contains the necessary information unique to the involved signal blocks for the latter processing of all relevant signal blocks going backwards from the present signal block. The WALK routine goes to the next previous signal block and puts the address of that next previous block as a second entry in the table ADRTAB, puts the address of the input and output bits as the second entry in the table INDTAB, and the same procedure is followed for the length and type data of the next previous signal block and so forth until finally all of the necessary information for the involved previous track signal blocks for processing of the detected train movement is stored sequentially in the respective four tables. In general the minimum of backward signal blocks that should be included here would be three signal blocks in relation to any provided occupancy indication I signal, unless a boundary condition or the like for a given station computer stored data is involved and in the case of short blocks the minimum number of signal blocks to contain the desired backup protection Q signals in relation to protecting a predetermined maximum length train could be increased until the relevant backup protection Q signal is established for each occupancy signal encountered. The minimum counter is incremented by one.

In greater detail in reference to the WALK flow chart shown in FIG. 7, for example assume that the first occupancy event change occurs in a present signal block and the type is interrogated to determine if the event is an occupancy. The program goes to LOAD to initialize a set of counters and a loading takes place of the desired data entries in the respective four tables. The direction bit of the present signal block is interrogated to see if a forward or reverse direction is involved, and if the direction is forward then a flag DIRFLG is set to zero and if the direction is reverse then the flag DIRFLG is set to one. If a type of block is a boundary, certain operations are required, if the type is a standard occupancy then other operations are required. A check is made to see if the capacity of the tables has been exceeded with 46 being an example of a suitable designated limit. If so, the program goes to the LOC routine, in order to indicate a problem in relation to a particular bit in which case no further processing is done on that bit. If the table size is not exceeded, a check is made to see if there is a false occupancy B signal associated with the present signal block and if not then is there a backup protection Q signal or a non-forcing protection S signal.

The non-forcing protection S signal is in effect a non-forcing backup protection Q signal and is utilized by above Equation (7) as follows: $O_N = I_N + Q_N + S_N + Q_{N-1}$. In relation to the train movement control provided by the above equation, the backup protection Q signal may be desired to be put into the signal block directly under a train but not to have that backup protection Q signal forced forward to control the speed code provided for the signal block ahead of the train. To accomplish this a table of special non-forcing protection S signals is provided which are operative to send a signal to the primary protection system only for a predetermined and desired particular signal block, such as a signal block where a train is located in a station or a train merge situation occurs.

Processing by WALK occurs only when an event change is detected, such as an occupancy indication signal I changing to a true condition or changing into a false condition. When an event change is detected, the WALK program then generates the table of data associated with that event change. In the example of an occupancy indication signal I change, this would involve a predetermined number of signal blocks immediately preceding the signal block where the occupancy indication I signal change occurred. This could include three signal blocks or all affected signal blocks having a backup protection Q signal or a false occupancy B signal or an occupancy indication I signal related to the particular train of vehicles that caused the event change that was detected. The signal block where the event change occurred is identified and relevant data from adjacent signal blocks through which the particular train has passed is included in the processing by the WALK program. There is always maintained at least one signal block between successive trains which separates the trains, and this signal block may have only an occupancy indication I signal but no backup protection Q signal, since a backup protection Q signal always follows a train and cannot be brought ahead of the train. Thusly the WALK program will process the relevant data back to a signal block which is the end of the effective Q line for a given train, which data is organized into the four tables.

The train control operations in accordance with the above equations are then processed using the data in the four tables, which data is arranged in sequential order with one set of entries for each signal block in the effective Q line for a given train that caused the detected event change. This produces the one or more output backup protection Q signals to the primary system in relation to the desired control of the movement of that train.

In the example of the false occupancy B signal situation, when the occupancy indication I signal changes for a given signal block, the WALK program starts back at least three signal blocks and may find no additional signals, either occupancy indication I signals or backup protection Q signals, then processing the above Equations (1) and (8) will result in setting the false occupancy B signal for the event change signal block and no backup protection Q signal will be provided for any of these signal blocks.

Figure 8:
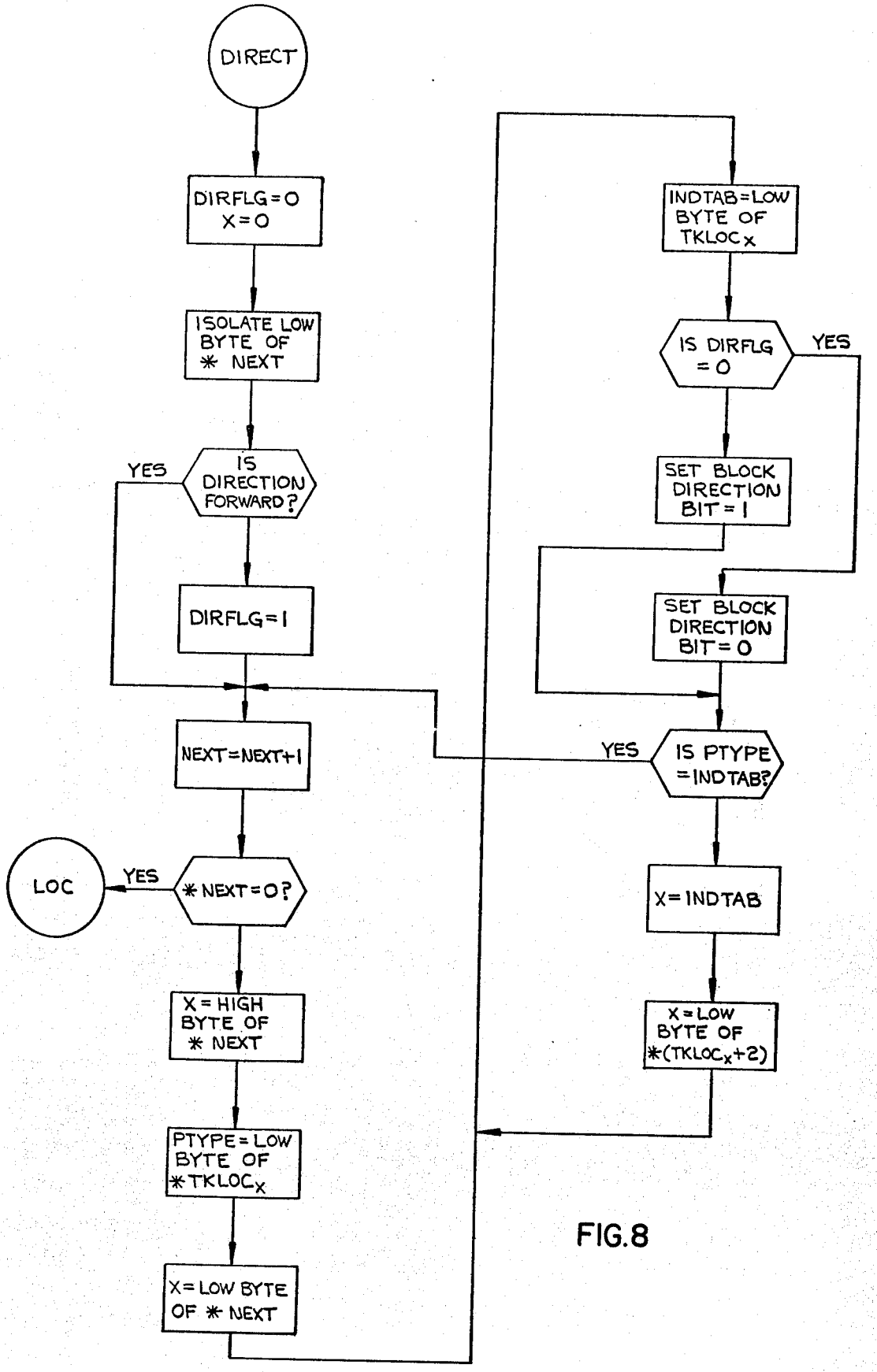
FIG. 8 is a flow chart illustrating the logic operation of the TRAFFIC DIRECTION routine.
Figure 9A:
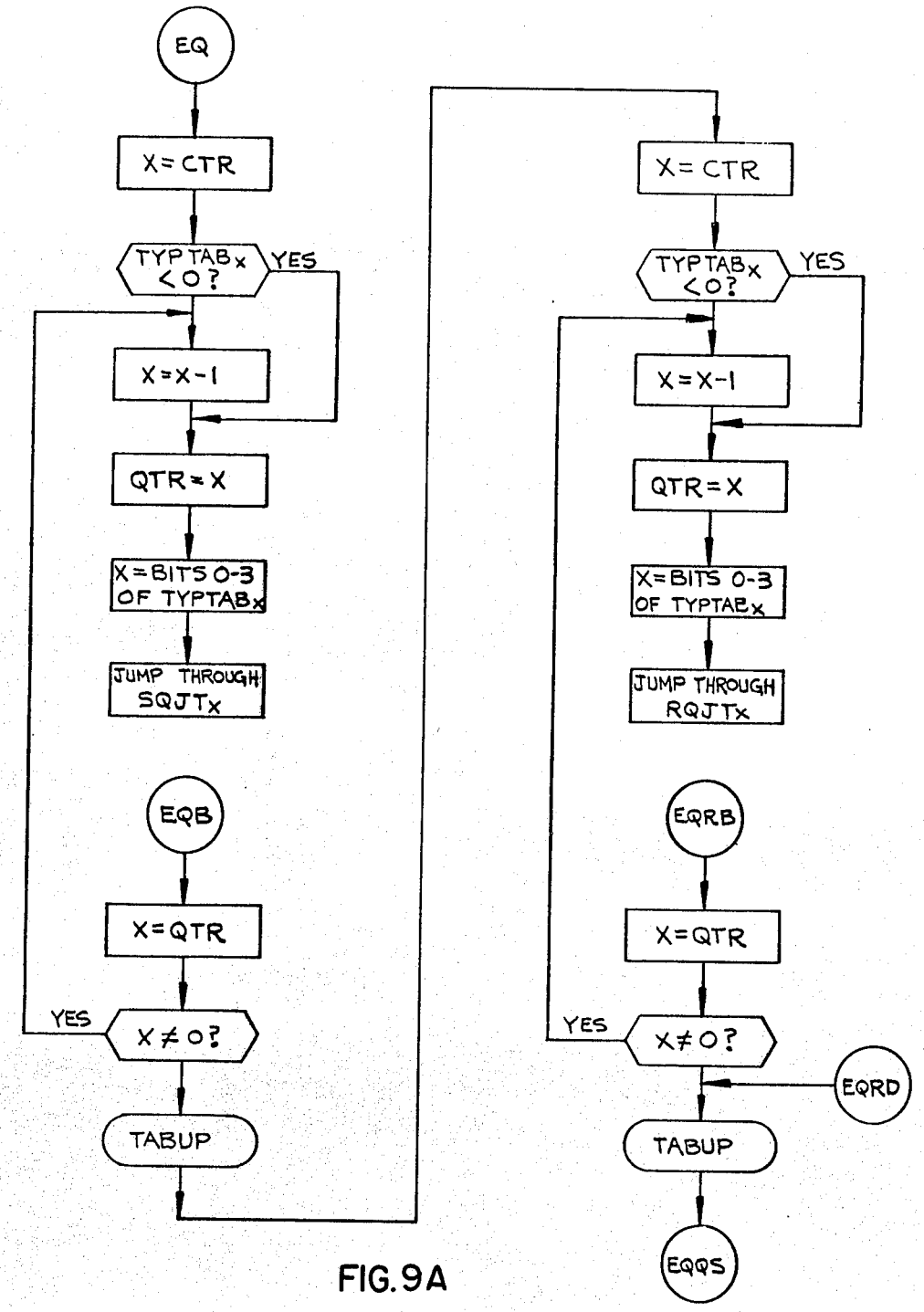
FIGS. 9A, 9B, 9C, 9D and 9E are a flow chart illustrating the logic operation of the EQUATION SCHEDULER routine.

In FIG. 8 the flow chart of the traffic direction program DIRECT is provided to set the directions. At any times later that an occupancy indication I signal event change would occur, the WALK program would again be entered and generate the four tables of selected data from the track plan which keeps up with the current status of all occupancy indication I signals, all false occupancy B signals and all backup protection Q signals in relation to a given station of signal blocks. The tables are filled in sequential order until a designated boundary of the station is reached or there are not more backup protection Q signals or the program has processed the data for a predetermined minimum number of signal blocks, going backwards from the event change as far as need be to encompass the provided Q line for a given train. When the WALK routine has finished its operation, an exit is normally made to the equations scheduler routine EQ shown in FIG. 9A.

The equations scheduler routine EQ, shown in FIGS. 9A to 9E, controls the operation of setting the backup protection Q signals, resetting the backup protection Q signals, setting and resetting the forcing function occupancy control O signals and setting and resetting any false occupancy B signals. Upon entering the EQ routine in addition to the four tables of data associated with the Q line for a given event change, the length of the table is forwarded to this routine which dynamically relates to the number of signal blocks of data involved, which length is CTR. That length initializes a counter and the type data in the type table TYTAB is used to choose the appropriate control equation. The above order (1), (6), (7), (8) of the equations is followed and the equations are processed from the rear of the Q line going forward in relation to the direction of train movement. There are 16 possible types of signal blocks and the routine EQ sets this type into an index register and then jumps to the proper equation through a jump table SQJT having 16 location addresses with the sub X being the type destination for the signal block being processed. For example, a regular signal block would be a type zero in which case X would be zero, so the routine EQ would jump to the $SQJT_0$ equation. If for example, the type were a gate block reverse this type might be 15 so the EQ program would jump to the address location SQJT + 15. The zero entry in this table is the set backup protection Q signal equation and so forth. On completion of the processing of the selected equation, the program goes back to the routine EQB which looks at the position of the signal block within the data tables to see if it is the last block to be processed. If not, the program returns to the top of the routine EQ and processes the next block in the tables in relation to the proper control equation and so forth until all signal block positions within the data tables are processed. Then the program goes to the routine TABUP for updating and then goes to the routine EQR which is the equation scheduler for resetting the backup protection Q signals. A similar operation is gone through starting with the type of the rear most block using the RQJT jump table and going through all blocks in the Q line for setting all backup protection Q signals that can be reset. The program then goes to the EQQS routine, which is the routine to determine the forcing function occupancy control O signal for each signal block in the Q line using the new status of the backup protection Q signals, and the forcing function occupancy control O signal provides the real time control of the train vehicle movement.

The primary train vehicle control system combines the OR logic of the occupancy indication $I_N$ signal with the backup protection $Q_{N-1}$ signal and the backup protection $Q_N$ signal to control the speed code for the next previous signal block N−1. The primary system operates in a failsafe manner in relation to the occupancy indication I signal, whereas the backup protection Q signals are not failsafe and by providing the forcing function occupancy control O signal in an OR logic operation with the primary system, a failsafe operation is maintained.

Within the EQS routine a counter is initialized to the block length of the four data tables, and the routine begins looking in the backup protection Q signal table and the non-forcing protection S signal table for a backup protection Q signal in a given block and a non-forcing protection S signal in a given block or a backup protection Q signal in the signal block behind that given block.

The non-forcing protection S signal is determined by the set Q and reset Q equations, since it is easier to construct a separate table of non-forcing protection S signals rather than work with a table of backup protection Q signals and additionally having to keep track of which are forcing and which are not forcing. For example, in the area of a station platform if a train pulls into the station and the doors of the train open, if no exception is taken to the basic equation there would be an occupancy indication I signal in the station block and a backup protection Q signal in the next previous signal block behind the station block. In relation to station blocks when an occupancy indication I signal is detected and also it is detected that the platform doors have opened, so a train is completely within the station or the doors would not open, a backup protection Q signal is desired underneath the train in order to prevent the loss of the detection and for the purpose that all station platforms are longer than 700 feet or 213.35 meters so if there had been a backup protection Q signal behind the train it can be set again because there are 700 feet of back-up protection Q signals up ahead. For example, if a signal block N is a station block, when a train enters signal block N such that an occupancy indication I signal is provided and the platform doors open then a backup protection Q signal is desired under the train. A predetermined time separation is desired between the trains, and if a train is in the station, by putting the backup protection Q signal associated with that train under that train this will permit a subsequent train to move into an additional signal block behind the train which signal block would otherwise be closed to the subsequent train. A train dwells in a station for about 35 seconds such that the following train may be influenced by the backup protection Q signal behind the station block to begin slowing down. The reset Q equations operate behind the train to reset the following backup protection Q signal, and the door opening event happens only once to bring the backup protection Q signal up under the train so it will then stay there until the train moves out of the station, since the door closing is ignored as a new event. According to the equation $O_N = I_N + Q_N + Q_{N-1} + S_N$ with the train in station block N the occupancy control $O_N$ signal for block N is calculated and output. Also the occupancy control O signal for block N+1 is calculated and output. Logically a table of output bits is updated everytime the table update subroutine is called and it is updated by any processing that has taken place in the last 0.4 second time interval, which gives an output signal to each signal block where required due to the above equations including a backup protection $Q_{N-1}$ signal that is set when the occupancy indication $I_N$ signal is provided. The occupancy control $O_{N+1}$ signal will be calculated ahead of the train and be included in the update of the table of output bits. To avoid forcing a backup protection Q signal ahead of the train and perhaps give a zero speed code to the block ahead of the train, a non-forcing protection S signal is provided. Thusly, in the example of a station platform where a backup protection Q signal is brought up under the train to avoid forcing this Q signal to influence the speed code in the block up ahead of the train, a non-forcing protection S signal is put under the train instead.

The routine EQQS operates with the same four data tables as previously described in relation to the set Q and reset Q equations. It constructs the part of the occupancy control O signal that is the signals $Q_N$, $S_N$, $Q_{N-1}$ for all track blocks in the four tables and involved with this particular event change that was detected. Eventually it exits to the routine EQBS which is the set and reset false occupancy B signal routine.

The EQBS routine looks at the forcing function occupancy control O signals that was just constructed for each signal block in the tables and it checks to see if the signal block is occupied and if not the false occupancy (B) signal for that block is reset since if there is not an occupancy indication signal (I) then there is no false occupancy (B) signal. In addition if the block is occupied the EQBS routine looks at the forcing function occupancy control O signal to see if it is true. If so, it does nothing since there is an occupancy indication I signal there and a forcing function either a $Q_N$ or $Q_{N-1}$ is there so if a false occupancy signal (B) is there it is left and if there is not a false occupancy (B) signal there it is not desired to put one there. If the signal block is indicated to be occupied and the forcing function signal O is false, then the occupancy must be false so a false occupancy B signal is set for that signal block and the routine goes to the next signal block and so forth. At this time all four functions have been processed; namely, the set and reset of the backup protection Q signal, set and reset of the forcing function occupancy control O signal, the set and reset of the false occupancy B signal. The EQBS routine exits to the LOC routine to look for more event changes.

If another event change is found in the buffer it is processed and if not the program goes to the OUTPUT routine.

Figure 13A:
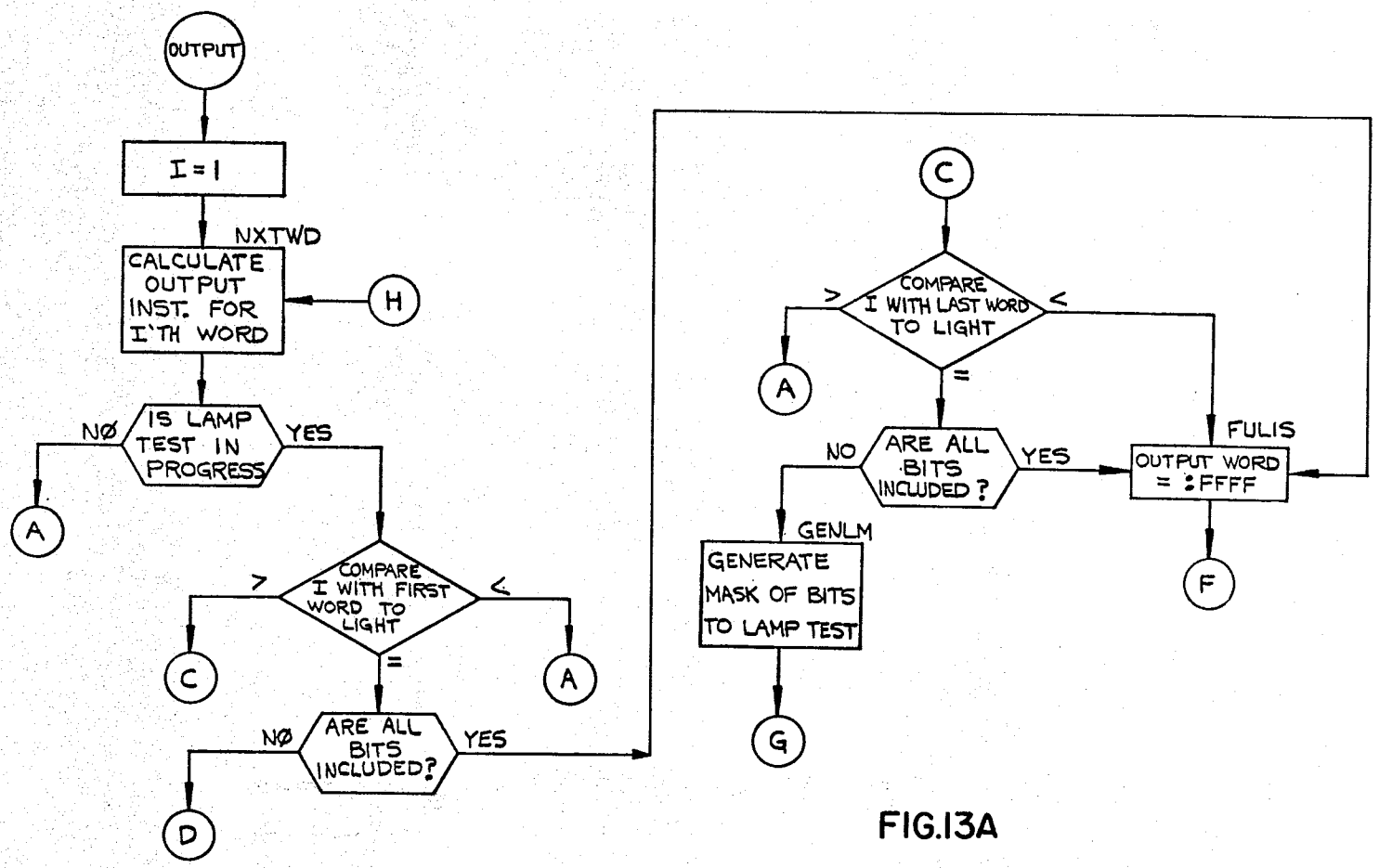
FIGS. 13A and 13B are a showing of the flow chart illustrating the logic operation of the OUTPUT routine.
Figure 13B:
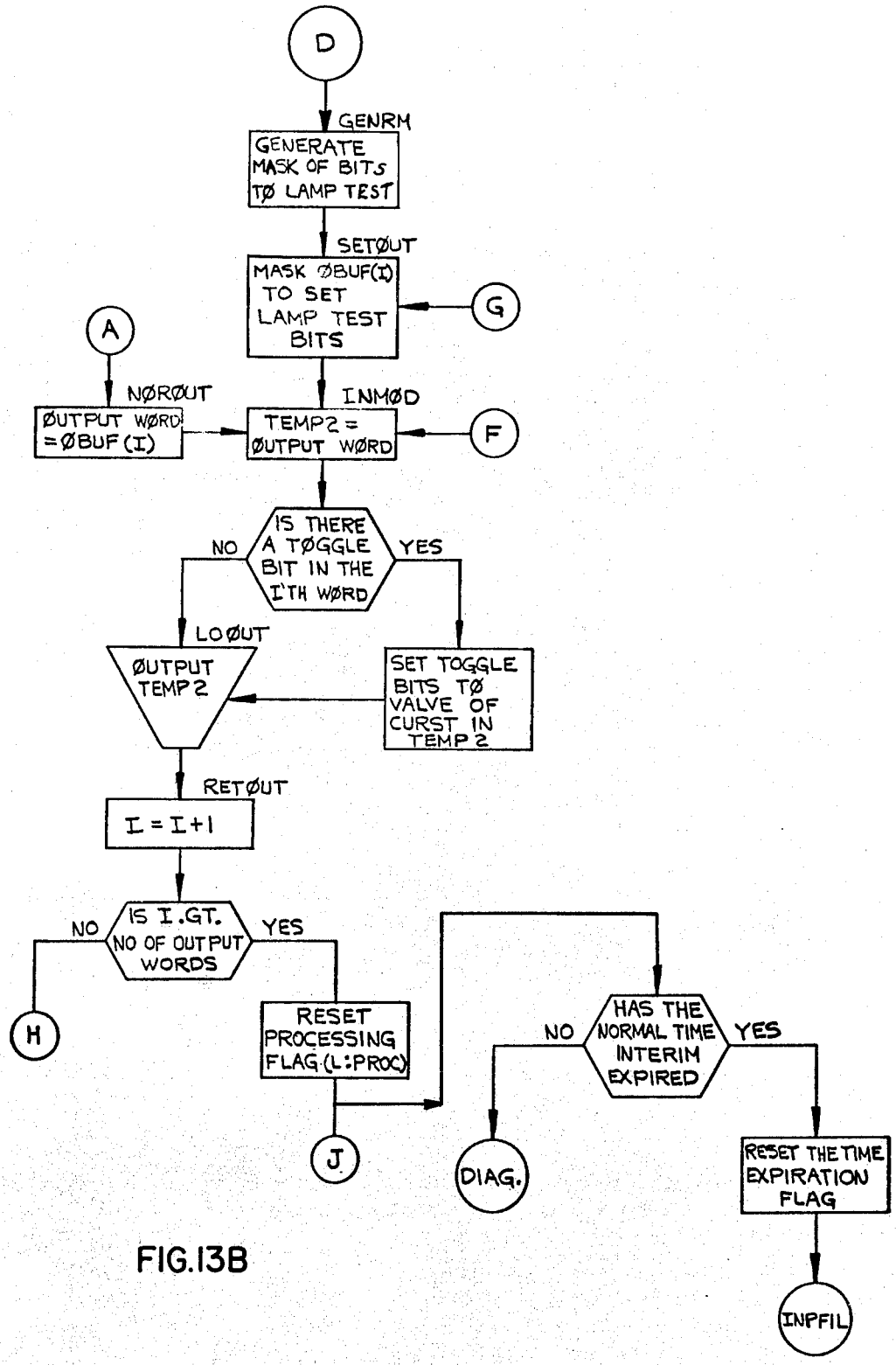

The logic flow chart of the OUTPUT routine is shown in FIGS. 13A and 13B. With no further changes to be found in the input buffers, the current status of all the output buffers are output. This is done by first calculating the index for the word to be output, and checking to see if that word to be output is currently concerned with a lamp test on the display board. If not, the word is output immediately, and if so, the bits which are concerned with the lamp test are set true and the word is output. At the completion of the output of a word the index of the output words is incremented and this index is compared with the number of words to be output. If all of the words have been output, the processing flag is reset. This flag is used in the scheduler routine to determine if all processing for a given iteration through the programs is complete. If all of the words have not been output, the index is incremented and the process is repeated for all words until all words have been output. If at the time all words have been output, checking of a flag set by the scheduler routine programs shows that in the last interval time has expired without the completion of all processing, rather than going to the idle routine or the diagnostic routine, the input and filter routine is entered immediately such that processing can begin for the next iteration through the programs which had been previously commanded but not responded to due to processing for the prior iteration not being completed.

Figure 14A:
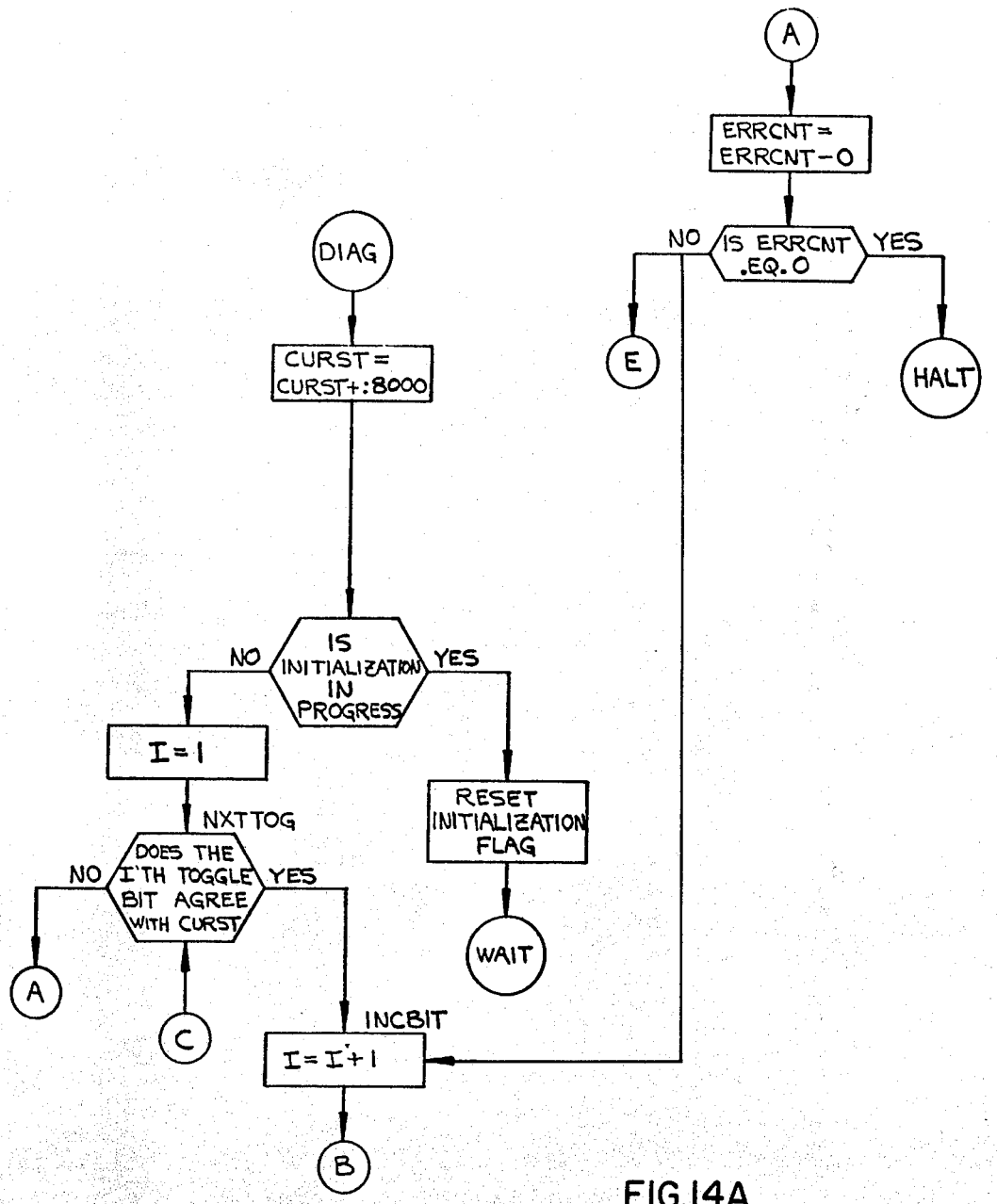
FIGS. 14A and 14B are a flow chart illustrating the logic operation of the DIAGNOSTICS routine.
Figure 14B:
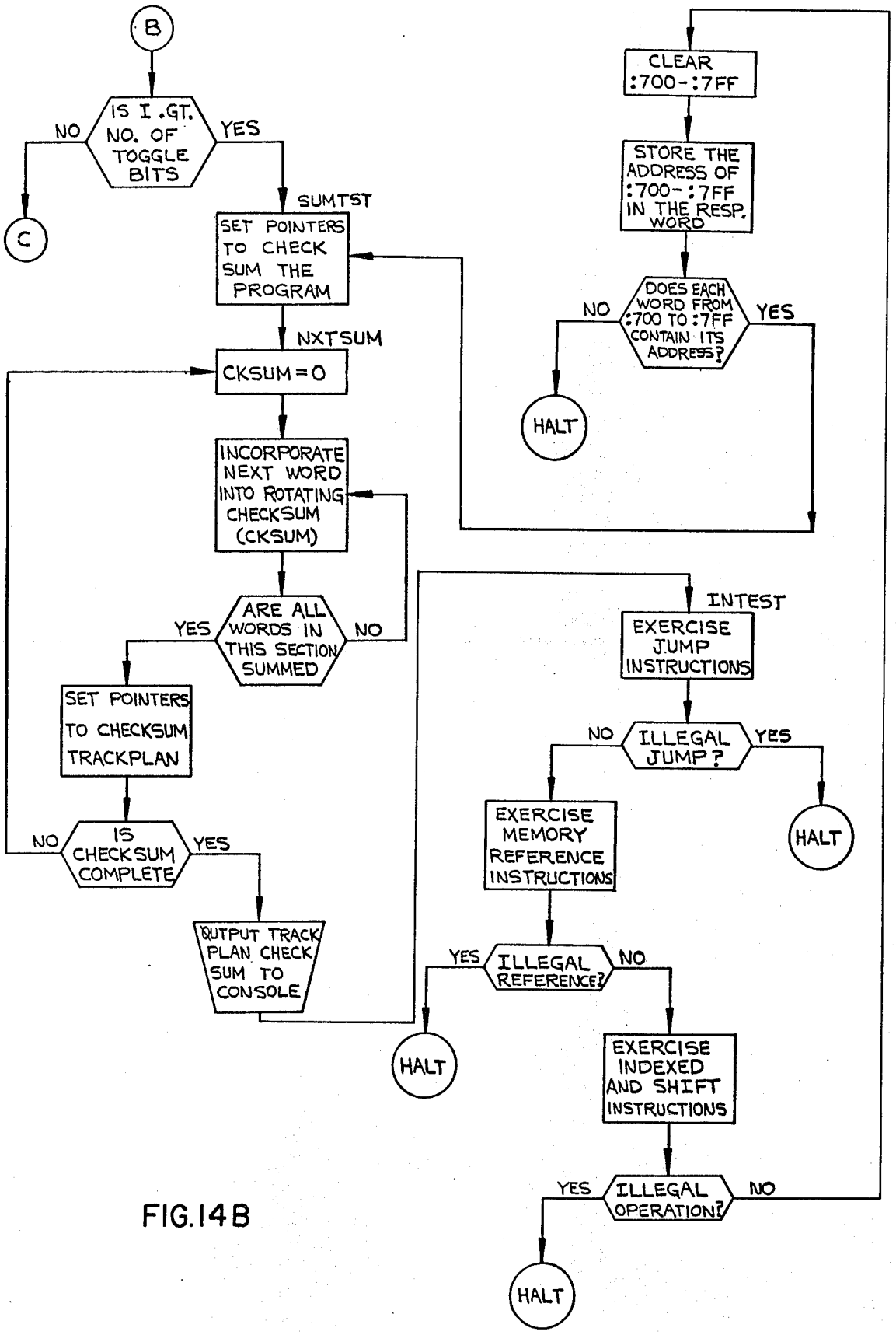

At the completion of normal processing of all outputs, the diagnostic routine is entered, as shown in FIGS. 14A and 14B. The diagnostic routine is executed until the next iteration interval is indicated by an interrupt from the real time clock at 0.4 second time interval. The diagnostic routine first performs an input/output or I/O test with certain bits in the I/O of the computer being tied together where the test consists of outputting a specific bit on one of the outputs and reading that bit on one of the inputs and verifying that the proper status of the bit is present on the input. If not, no determination is made as to what has failed whether an input or an output, and a counter is incremented. If the counter exceeds a preset value, the program halts. At the halt of the program for failure of this or any other diagnostic, a timer external to the computer expires and process control switches to the backup computer in which the processing continues.

At the completion of the input/output test, the diagnostic program executes a check sum test in two areas. One, it performs a cyclic check sum of all program instructions necessary to perform operations previously described, and compares that with the preset check sum. If the check sums agree, the processing continues, and if not, the computer is halted. A check sum is also computed for the data tables that exist to describe the particular station geometry under control of this particular computer, and if the check sum agrees with that precalculated, then the processing continues. If it disagrees, processing halts. Next in line, having passed the check sum tests, the diagnostic routine executes instruction tests, with not all instructions being tested but rather all instructions of a given type being tested, for a representative sample of the instructions being used in the control programs, to determine whether a particular control computer itself has failed. If any of these tests are faled, the involved control computer halts; and if the tests are not failed, the processing continues. The last test is a read and write test of random access memory, where the address of a selected body of memory is stored in memory and then read back and verified. As in other tests, if the computer fails to pass these tests, it halts. If it does in fact pass these tests, processing continues. The diagnostics are then repeated starting with the check sum tests, until interrupted by the 0.4 second clock.

The two wayside programmed digital control computers for each station operate in a primary control and backup control arrangement, with each computer simultaneously performing all of the primary function calculations and with the outputs of each computer being connected through respective logical devices to produce the control signals to the train vehicle movement control process for the performance of the function of the desired sequential occupancy release operation. If the operation of either control computer is halted, which typically could be the result of failure by one control computer to pass some diagnostic test performed in real time, the output of the halted computer is terminated at the expiration of a hardware timer setting. At the expiration of this timer setting, the outputs of the halted computer are determined to a state such that the other computer when operating through the respective logical devices is in complete control of the train vehicle control process.

Figure 12:
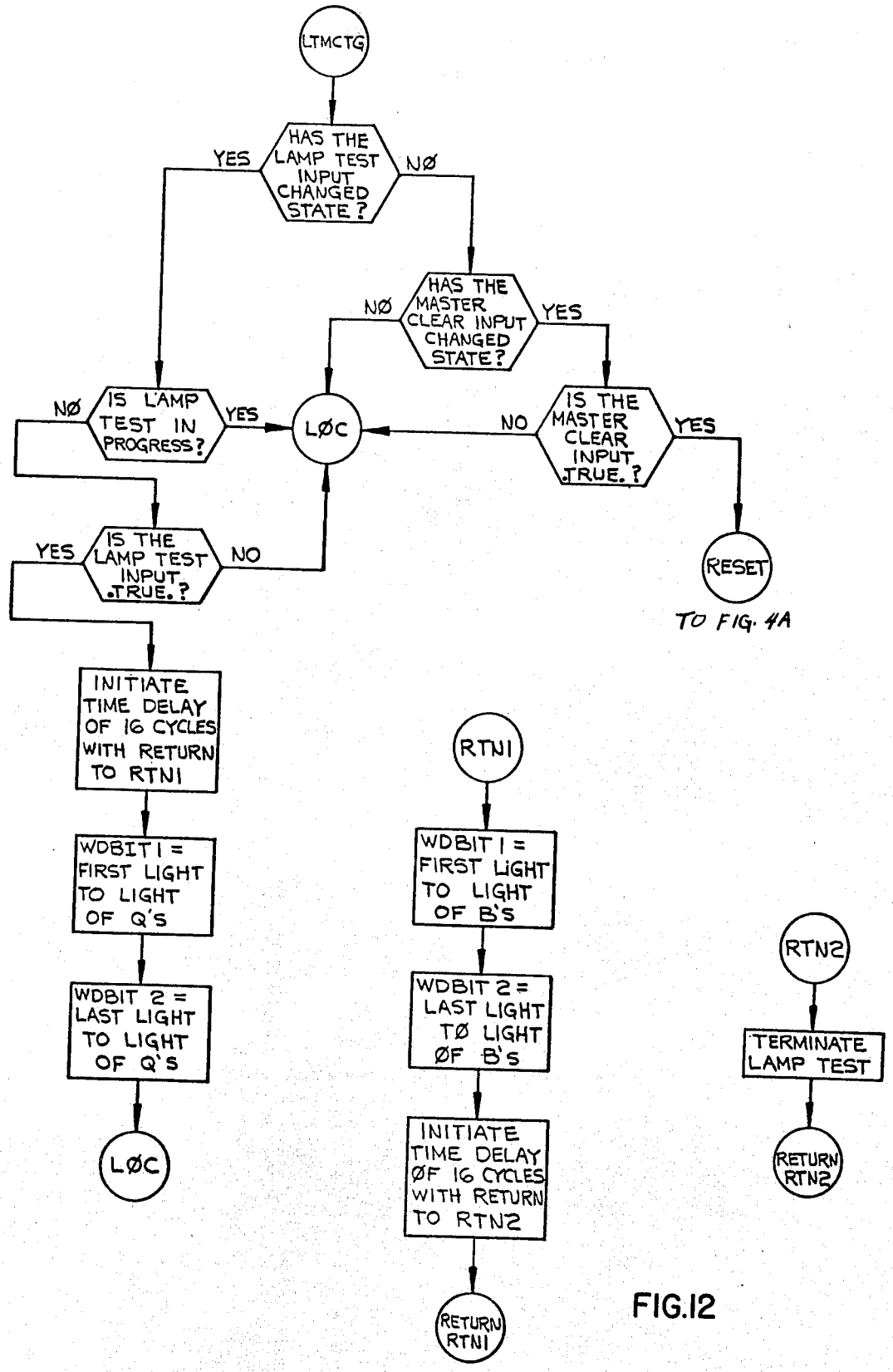
FIG. 12 is a flow chart illustrating the logic operation of the MISCELLANEOUS UTILITIES routine.

The miscellaneous utilities program, as shown in FIG. 12, includes two parts. The lamp test function and the master clear function. Since it is desirable to have a method of resetting all of the latching protection outputs or Q signals at some time, in the case of some inordinate operational complication such as may be induced by manual operation of a train vehicle through the signal blocks of one or more stations, a clear button is provided to reset all of the inputs and all of the outputs in the control computer memory to zero. Then, the control program reinitializes itself, in a manner similar to startup, by processing changes through the buffer, in which case all inputs are noted as changes. The lamp test function provides for an input telling the control computer to illuminate sequentially by selected type, such as I, B and Q, all of the lamps on the provided display boards to identify any burned out lamps. The program is entered, a check is made to see if the lamp test input has changed state. If it has, a determination is made to see if the lamp test is currently in progress, and if so, no further processing is done and the LOC routine is entered. If not in progress, a check is made to see if the noted change of state was to the true condition, when appropriate flags are set in memory to allow the OUTPUT routine to set the bits concerned for all of the Q signals on the display board to be set true for illuminating the Q lamps. A time delay is also set at the expiration of which the lamp test routine is reentered, which sets up appropriate flags for the output routine to display all of the false occupancy B signals on the display boards for illuminating the B lamps. When all desired lamps have been checked, another time delay is set at the expiration of which the lamp test is terminated. If when the lamp test input was checked, it had not changed state, the master clear input is checked to see if it has changed state. If not, the LOC routine is reentered. If it has, the master clear function is implemented and all of the input tables and all of the output tables are set to zero, and processing is reentered in the scheduler routine as though a 0.4 second interrupt had just occurred.

The set non-forcing protection S signal in a station block requires that there be an occupancy indication I signal in the station and a door open signal. The set Q in the station equation is modified to include the occupancy indication I signal in the subsequent signal block and there is not a backup protection Q signal in the station but there is a non-forcing protection S signal in the station. The reset Q in the station equation is the regular reset Q equation, the reset Q in the signal block before the station is a Q signal or an S signal in the station.

In relation to a train movement across a boundary between station areas of signal blocks, the station computer entrance requires only the presence or absence of occupancy in the previous station computer area which is known. The present train control system is designed to protect against loss of occupancy detection and does not initialize the Q line for succeeding station control computers determined by the presence or absence of train occupancy in a previous station computer since the loss of that occupancy is to be protected. Thusly if any of the first three signal blocks in a given station computer is occupied then a backup protection Q signal is set for the first signal block. A back-up protection Q signal from a previous station computer does not carry over into the succeeding station computer since the guard against loss of occupancy is the objective of the present train control system.

The prior art train control Equations (1) to (5) determine a general broad concept of train control whereby the location of a given train in relation to given signal blocks is established and the train location is remembered for protecting against rearend collisions by the following train. The sequential occupancy release train control system here described operates as a backup occupancy protection system in relation to the primary train control system. A typical transit system track arrangement includes two parallel tracks with each such track including a pair of rail members and with one track being provided for normal running in a first direction and the other track being provided for normal running in a direction opposite to that first direction. The control system operation here described in relation to the train control operation provided by above Equations (1), (6), (8), (4) and (7) can conveniently treat both directions of train vehicle travel along a given track the same. The train control operations associated with these equations all apply the same for both directions of travel with the only difference being the indicated direction of travel.

Each station of signal blocks is provided with two wayside programmed digital control computers performing all necessary calculations simultaneously, and such that both output all backup protection Q signals to the primary protection system. If either control computer for a given station operates erroneously to hinder train movements, the primary train protection system will respond to these erroneously provided backup protection Q signals in a fail-safe manner. If both control computers in a given station of signal blocks fail in operation and provide no output backup protection Q signals or no false occupancy B signals, the primary system will still control the train movement in response to the occupancy indication signal I as it did before the present train control system is added.

Each control computer includes a diagnostic program, such as illustrated in FIGS. 14A and 14B. The normal computer cycle is about 0.4 second and most of this time is idle since each computer operates on an event change basis, so the remainder of the computer time is utilized for the operation of the diagnostic program. A communication is provided between each wayside station control computer and the central station computer, such that an indication is provided to the central operator personnel whenever a wayside station control computer should fail. If a wayside control computer should fail to provide a desired backup protection Q signal in some signal block, when a train arrived at that signal block the train would safely stop and the train operators would respectively then proceed through the signal block manually until the necessary maintenance for the failed wayside station control computer could be completed. In the meantime, the companion wayside station control computer would operate the control system satisfactorily.

Figure 15:
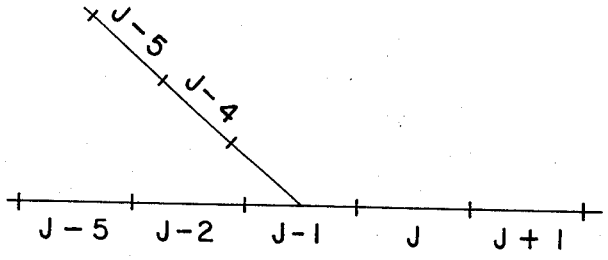
FIG. 15 shows an illustrative diagram of the track arrangement in relation to merging trains at interlockings.
Figure 9B:
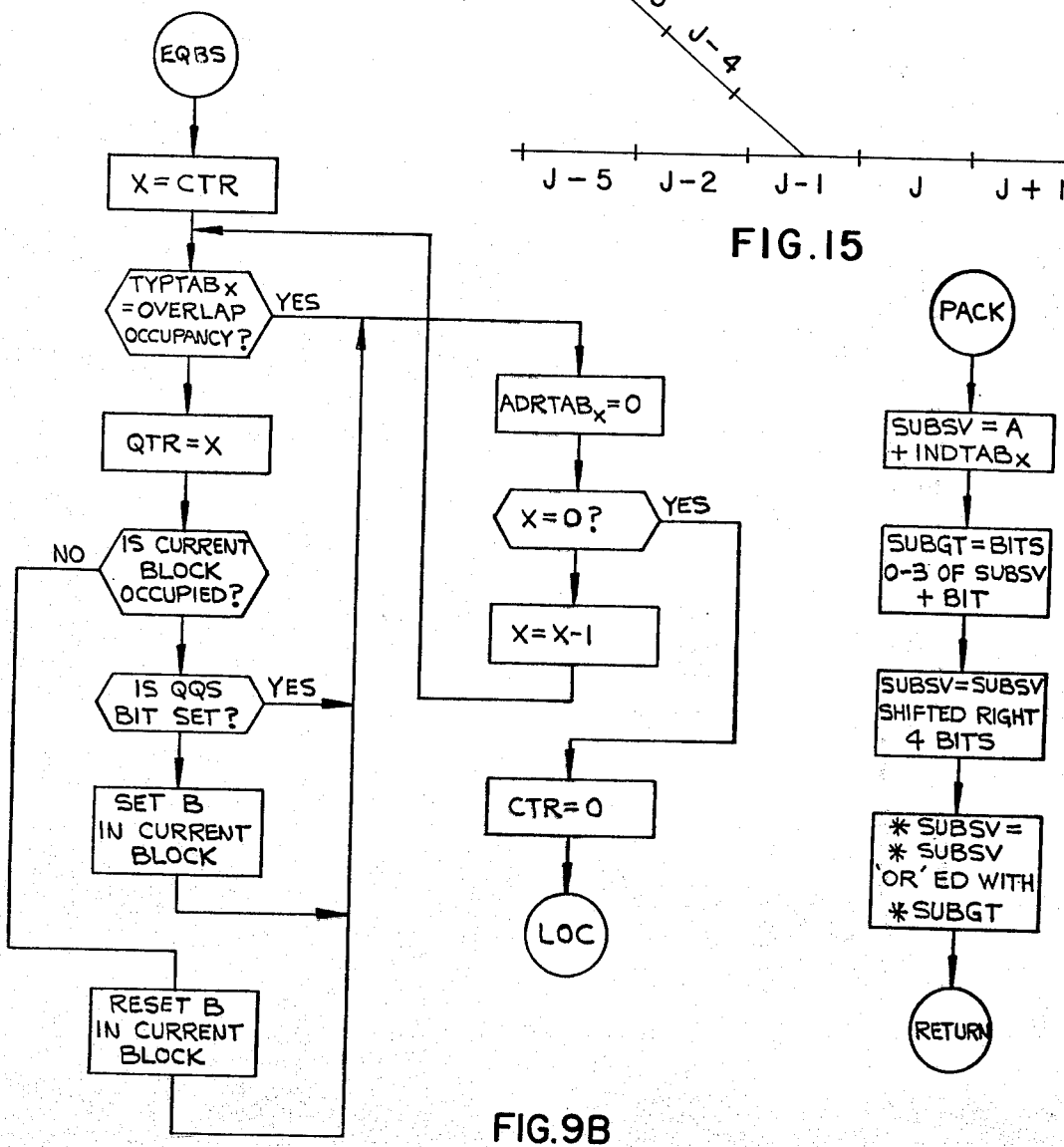
Figure 9C:
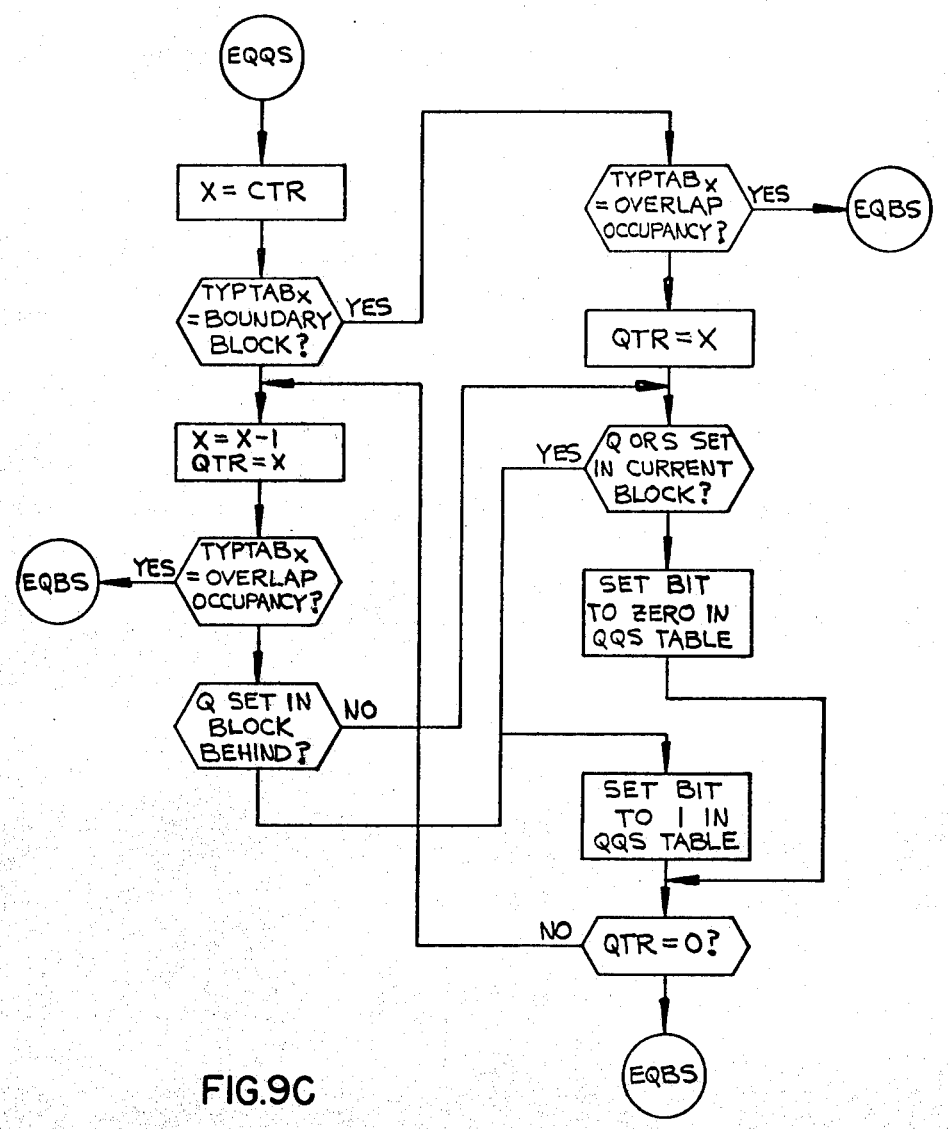
Figure 9D:
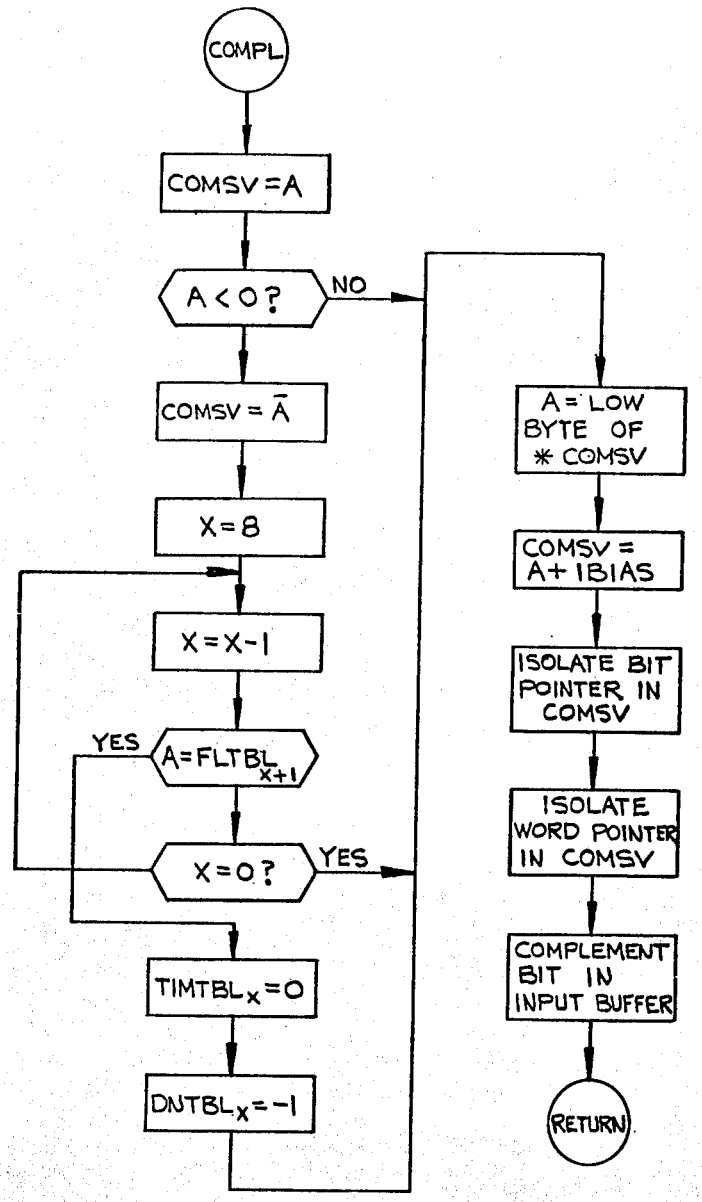
Figure 9E:
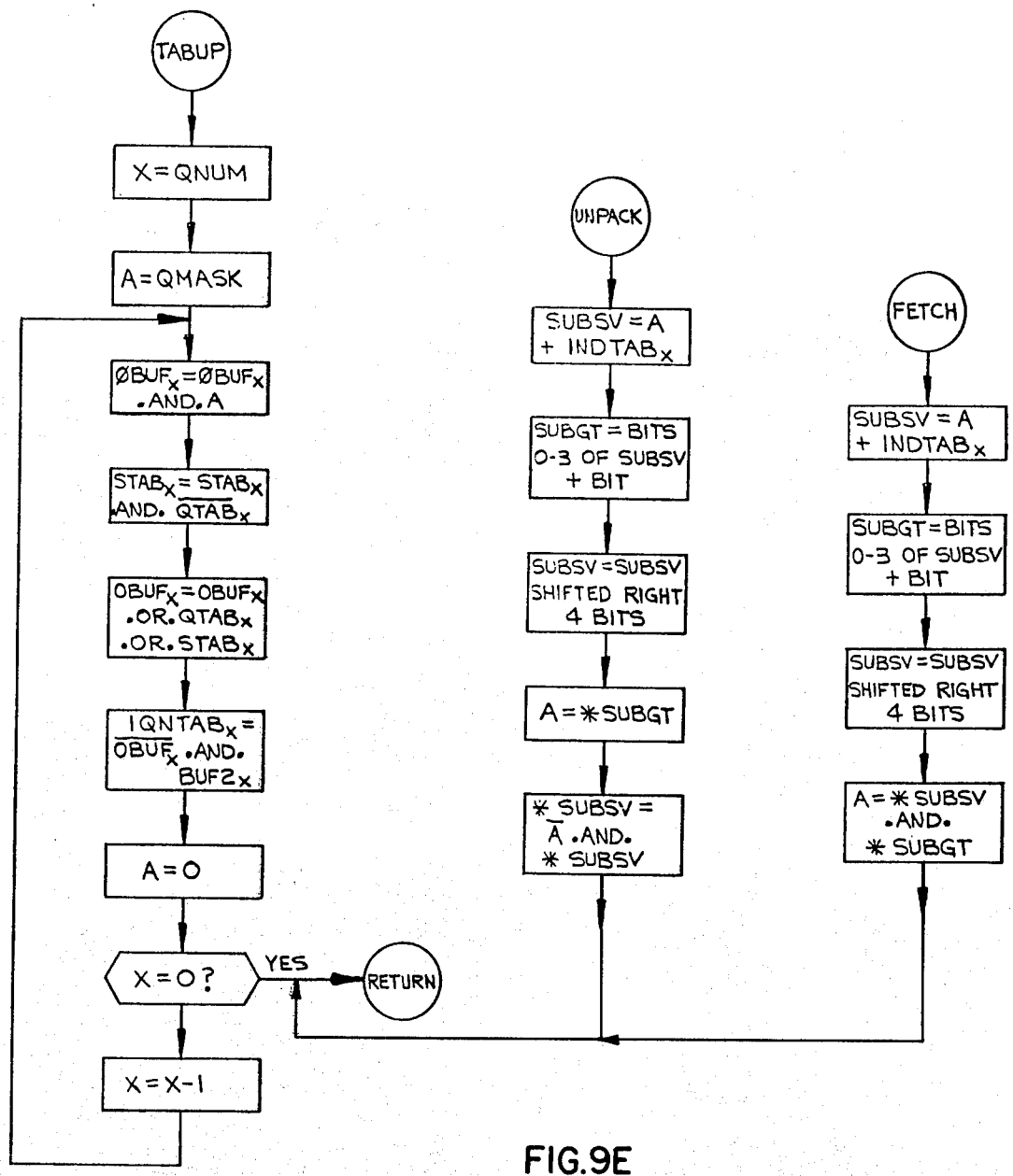
Figure 10A:
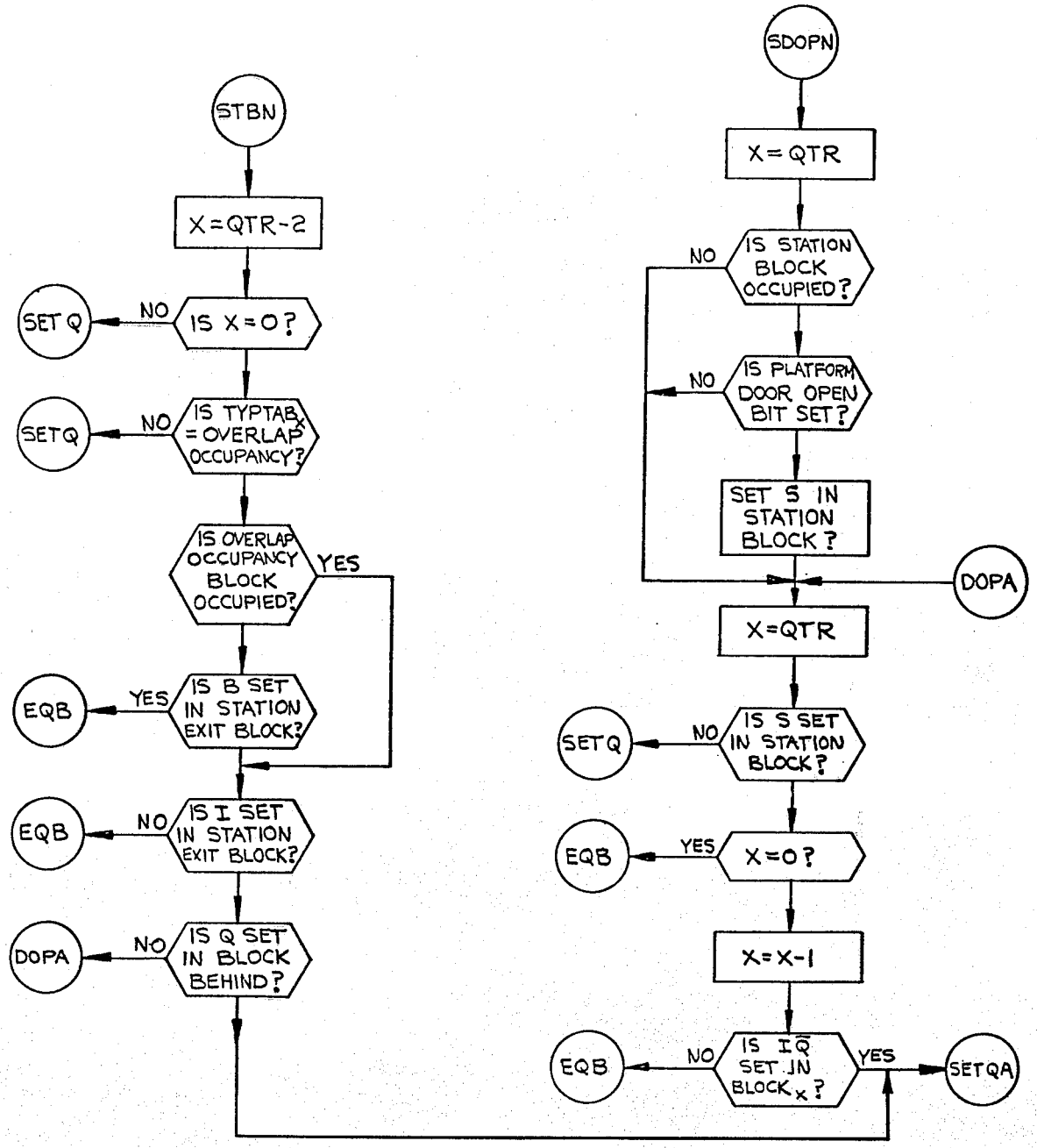
FIGS. 10A, 10B, 10C, 10D, 10E and 10F are a flow chart illustrating the logic operation of the SET Q routine.
Figure 10B:
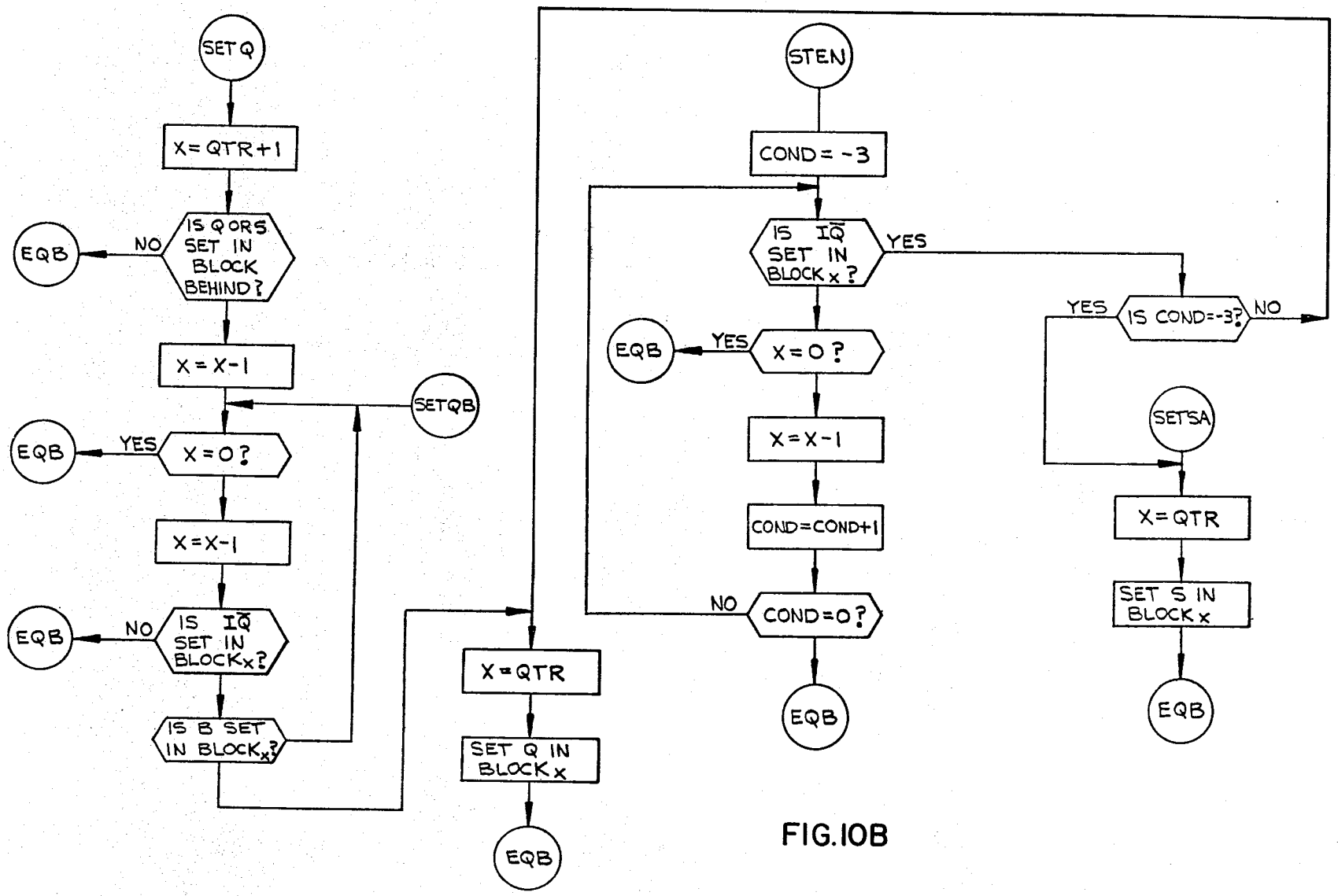
Figure 10C:
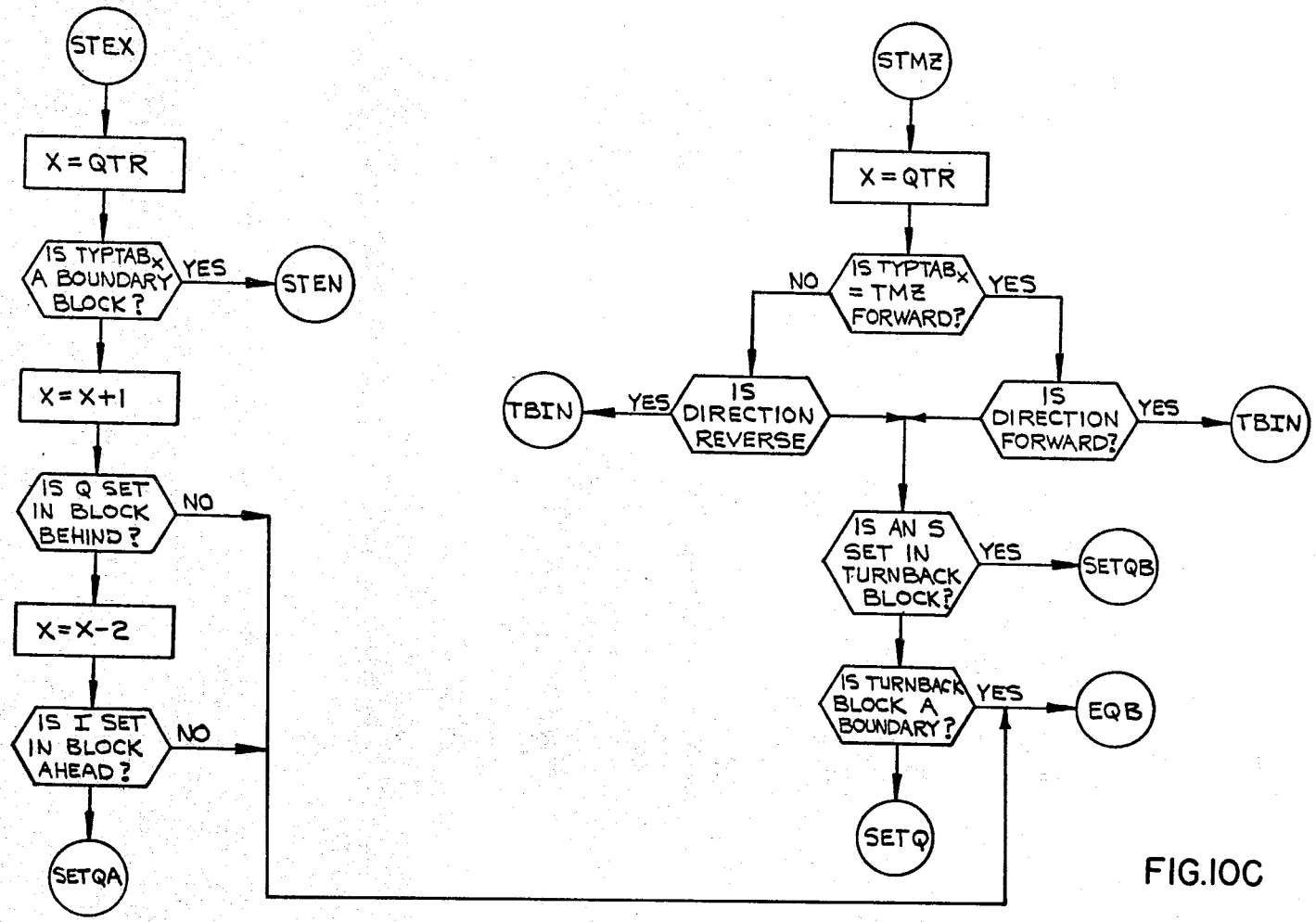
Figure 10D:
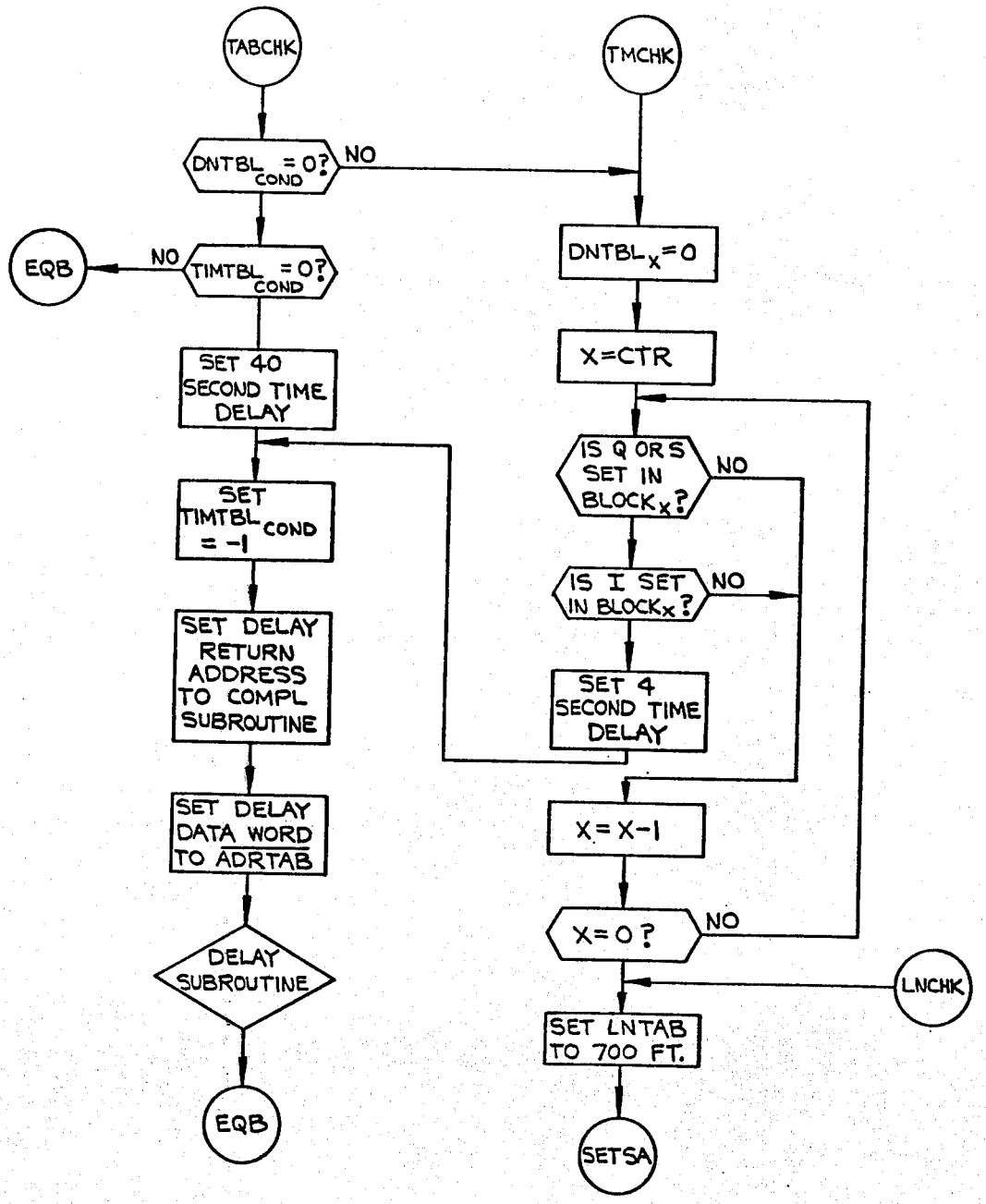
Figure 10E:
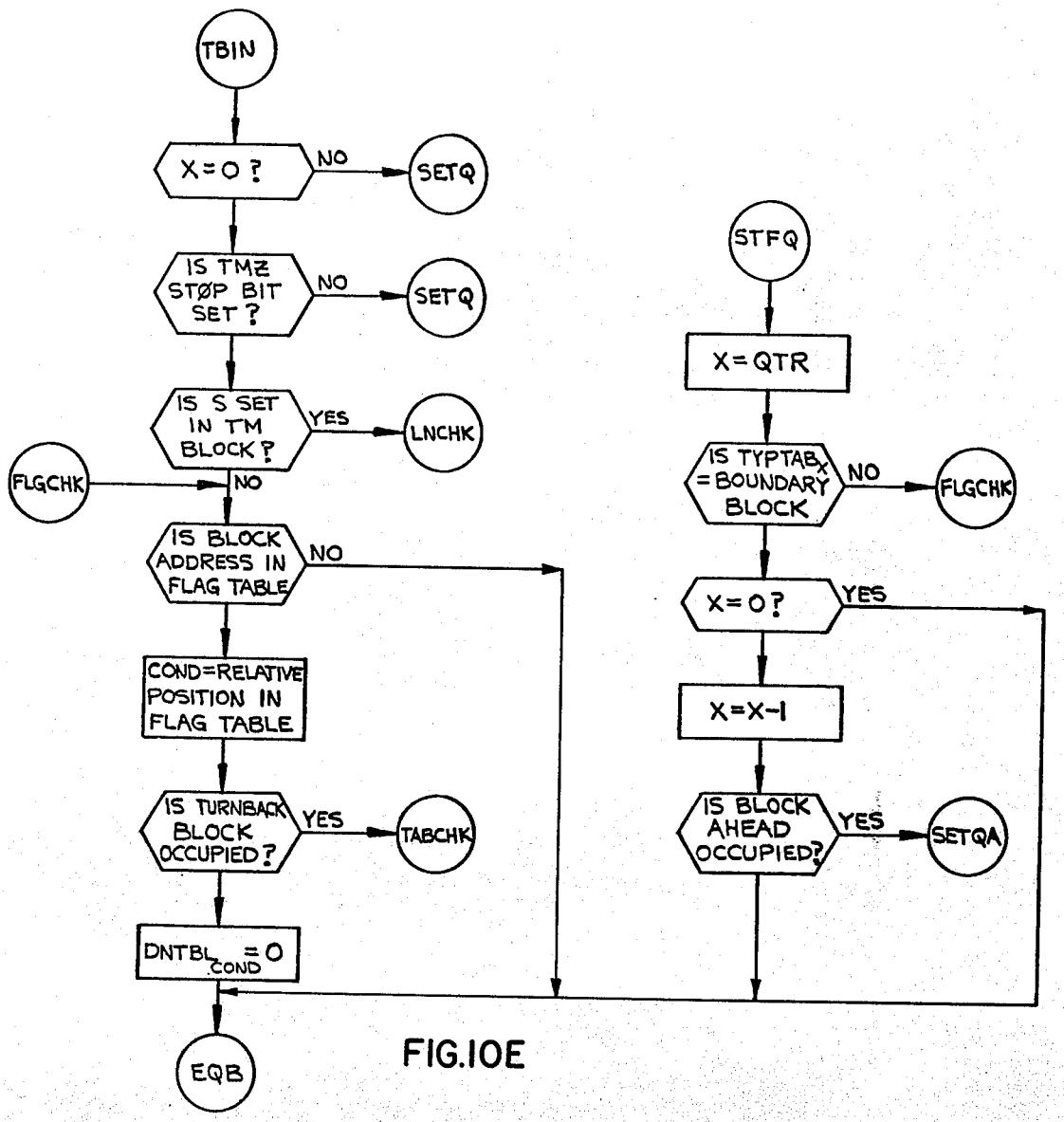
Figure 10F:
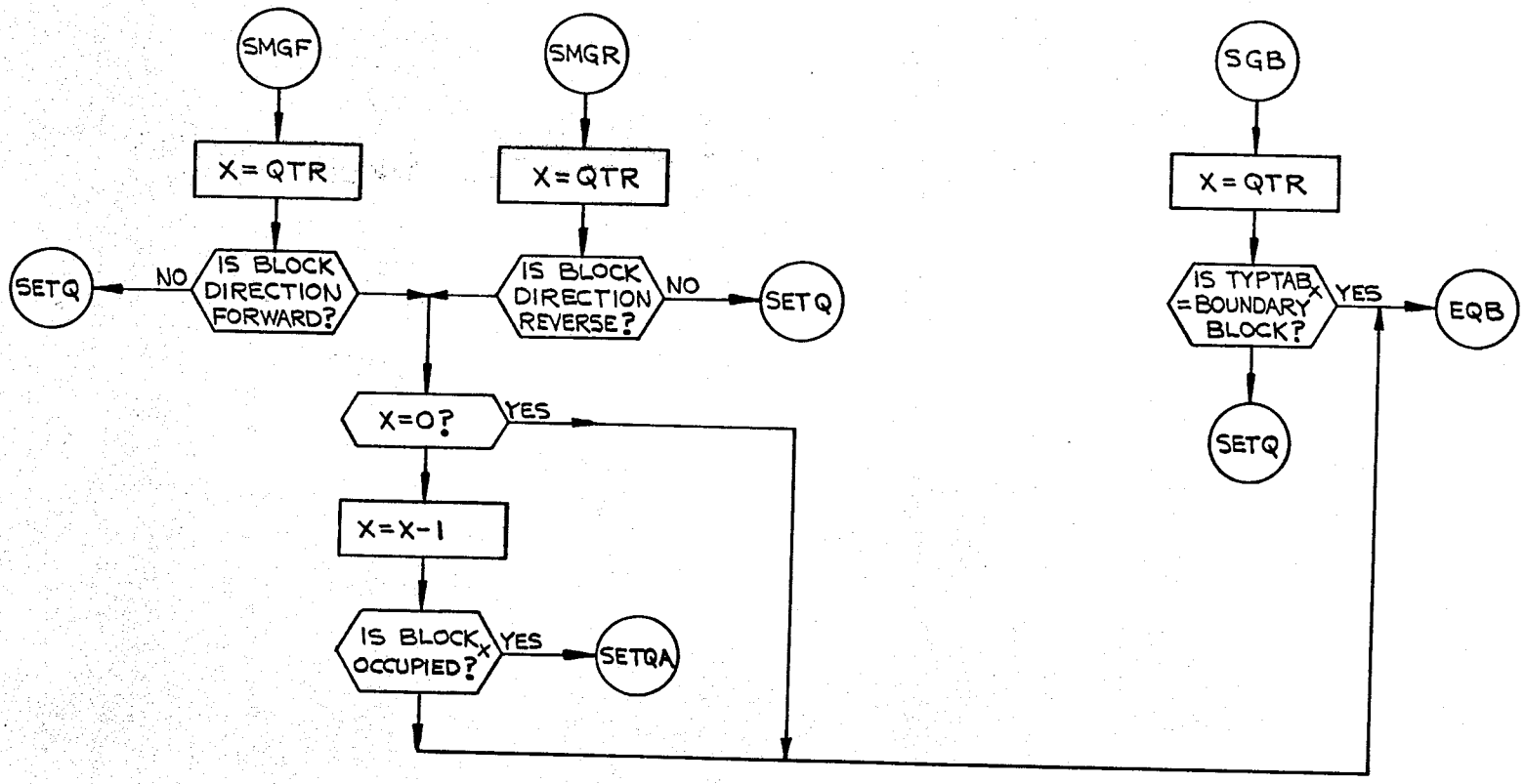

As set forth in the disclosure of the above referenced related patent application, a train occupancy in signal block J+1 of FIG. 15 will set true a protective $Q_J$ signal in signal block J of the main track immediately following the merge point of the merge side track into signal block J−1.

Figure 4B:
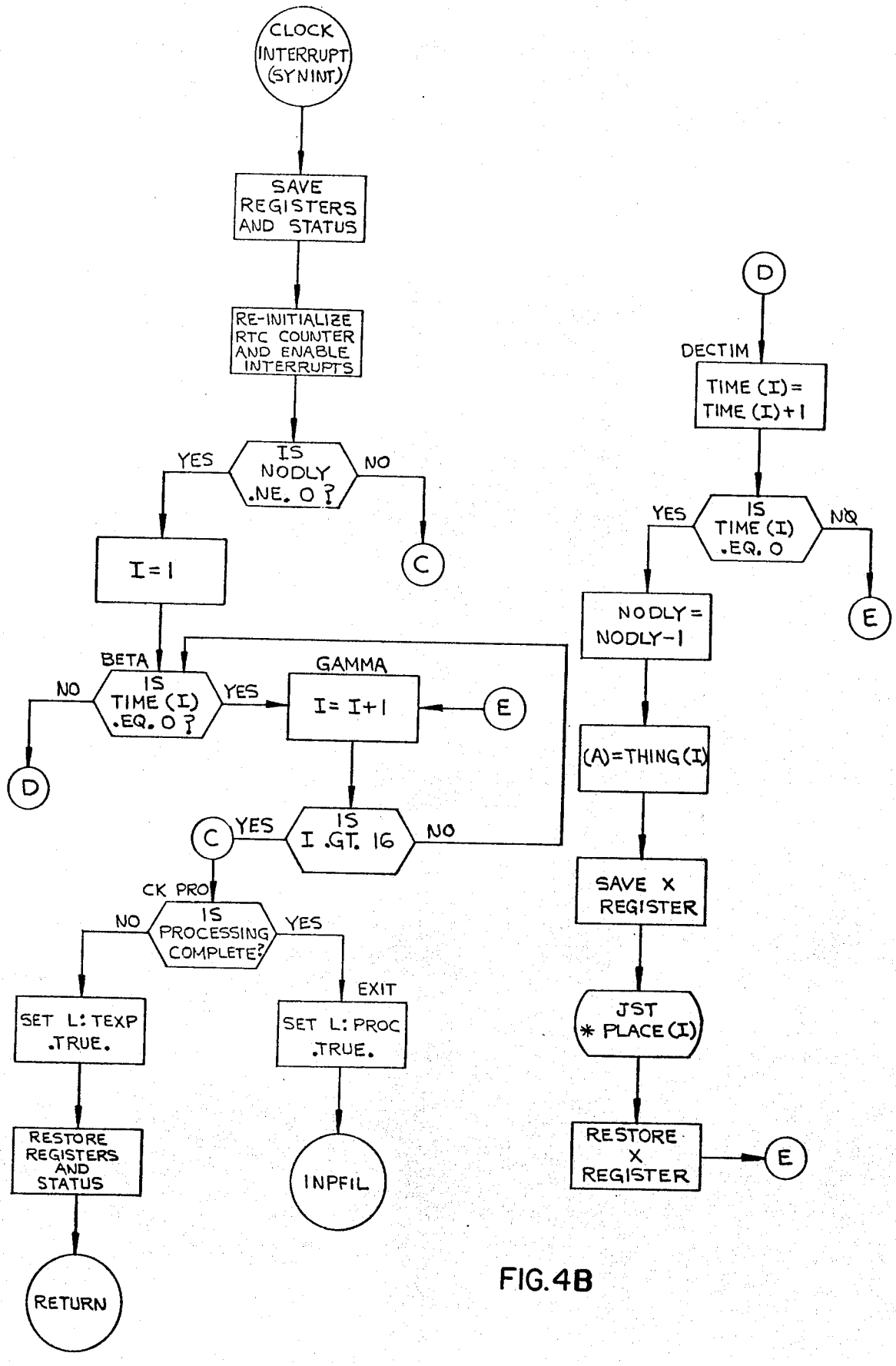
Figure 11A:
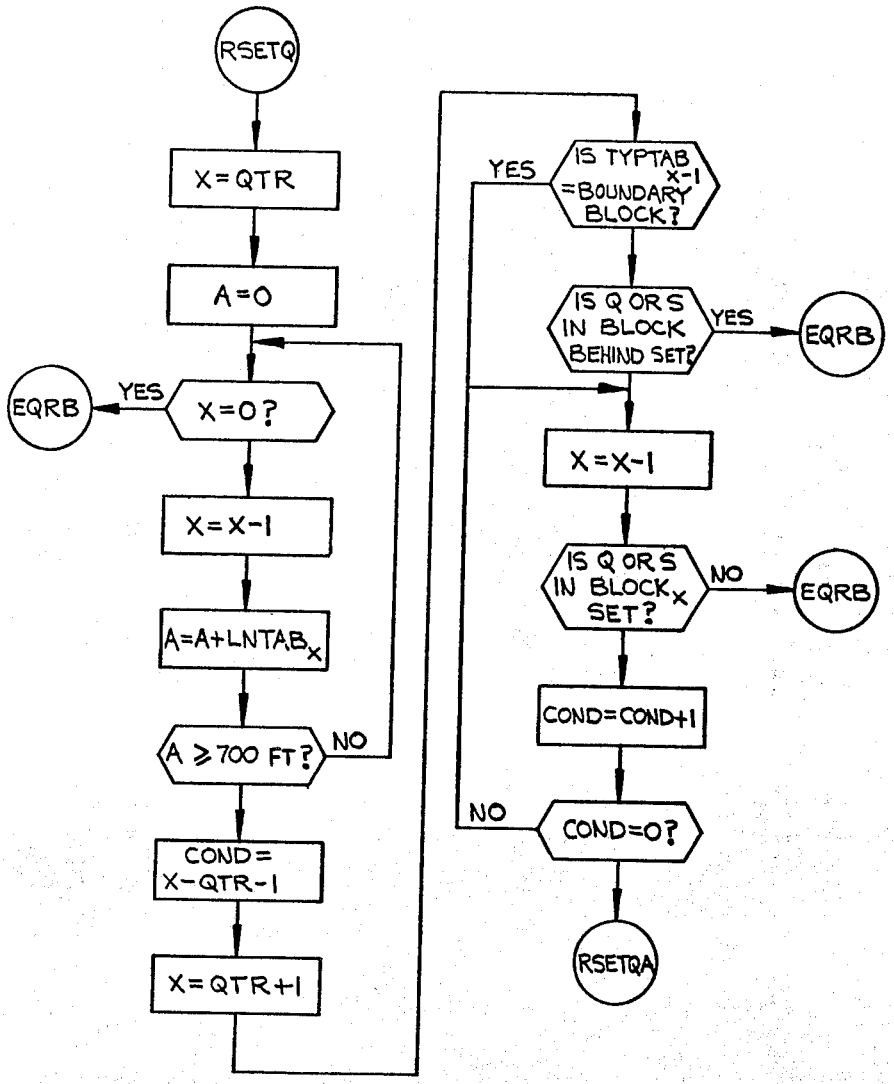
FIGS. 11A, 11B and 11C are a flow chart illustrating the logic operation of the RESET Q routine.
Figure 11B:
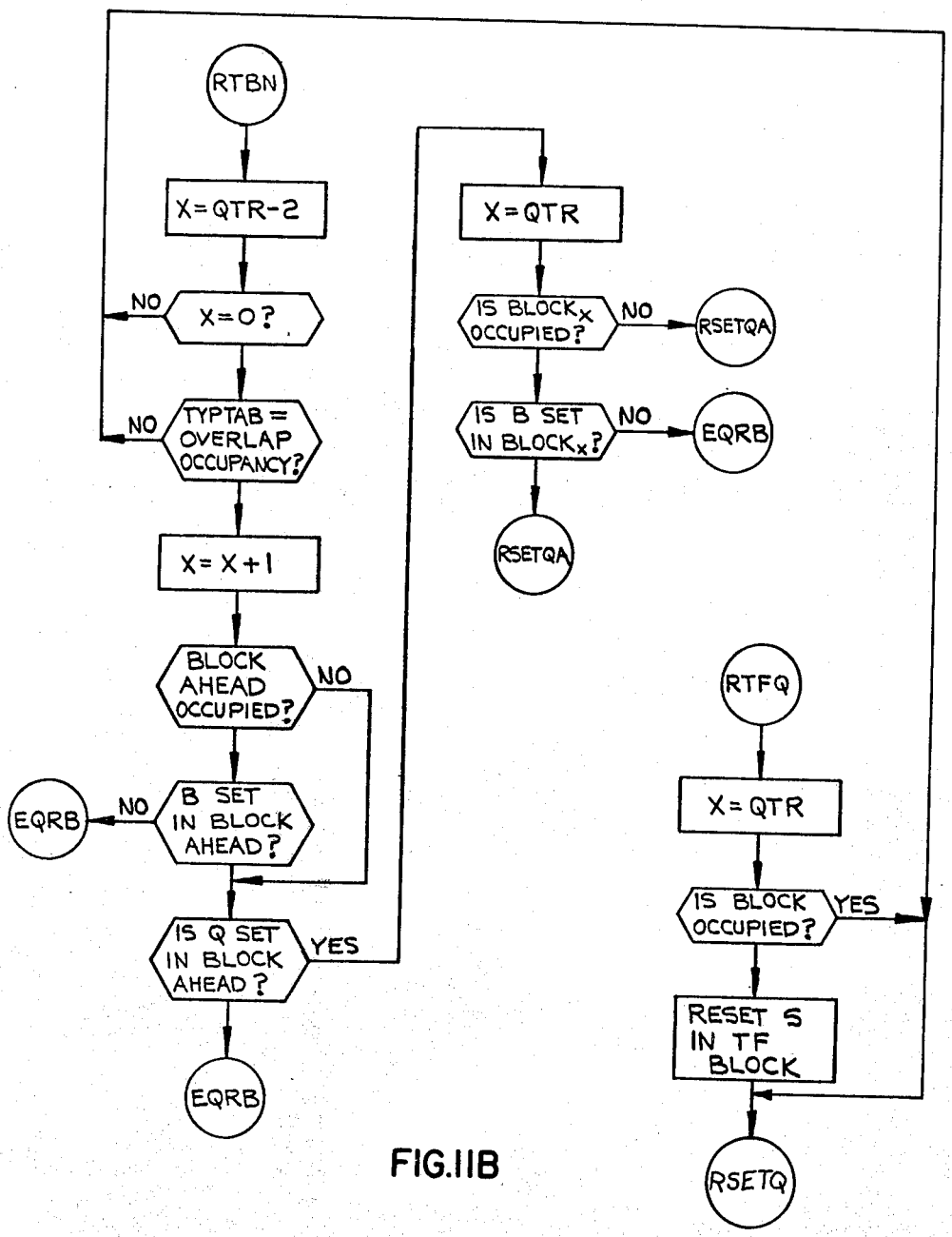
Figure 11C:
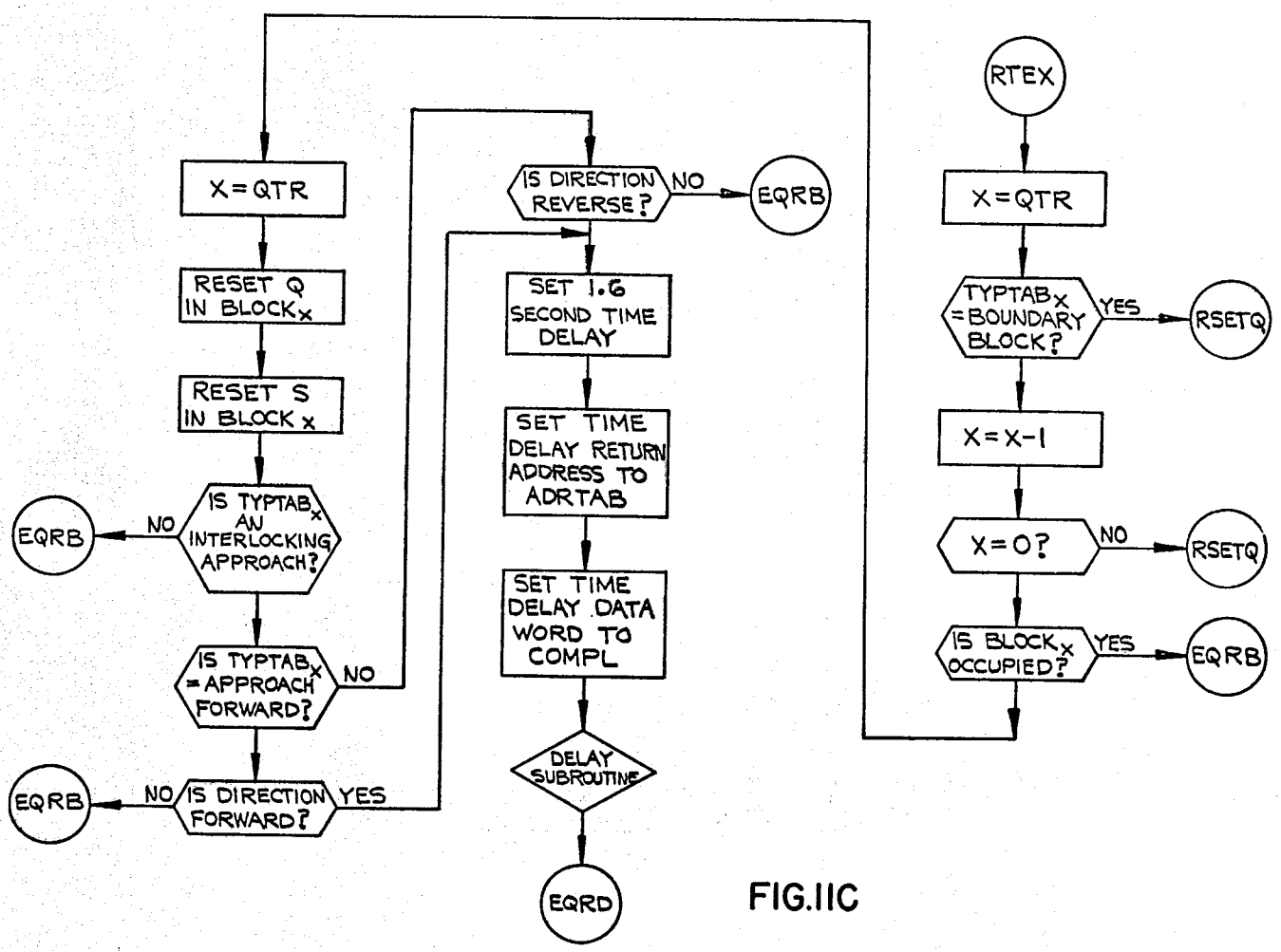

There is included in the disclosure of the above referenced related patent application an instruction program listing that has been prepared to control the movement of one or more vehicles coupled together to form a train in accordance with the here-disclosed train vehicle control method and apparatus, and in accordance with the SCHEDULER routine flow chart shown in FIGS. 4A and 4B, the INPUT AND FILTER routine flow chart shown in FIG. 5, the LOCATE CHANGE routine flow chart shown in FIG. 6, the WALK routine flow chart shown in FIGS. 7A, 7B and 7C, the TRAFFIC DIRECTION routine flow chart shown in FIG. 8, the EQUATION SCHEDULER routine flow chart shown in FIGS. 9A to 9E, the SET Q routine flow chart shown in FIGS. 10A to 10F, the RESET Q routine flow chart shown in FIGS. 11A to 11C, the MISCELLANEOUS UTILITIES routine flow chart shown in FIG. 12, the OUTPUT routine shown in FIGS. 13A and 13B, and the DIAGNOSTICS routine flow chart shown in FIGS. 14A and 14B.

We claim as our invention:

1. An apparatus for controlling the speed of a plurality of train vehicles along a track including a plurality of signal blocks, the combination of means for providing an occupancy indication signal in relation to the occupancy of a first signal block by one of said train vehicles, means for providing first and second protection signals in relation to a second signal block previous to said first signal block and in response to said occupancy indication signal, and means for providing an occupancy control signal in response to a selected one of said first and second protection signals in accordance with predetermined characteristics of said first signal block.

2. The apparatus of claim 1, with said occupancy control signal being operative with said second signal block to determine a zero vehicle speed code in said second signal block when said one train vehicle occupies said first signal block.

3. The apparatus of claim 1, with said occupancy control signal being operative with said second signal block to control the speed of a succeeding train vehicle in relation to said second signal block.

4. The apparatus of claim 1, with said first signal block being signal block N, with said second signal block being signal block N−1, and with said occupancy control signal being provided in accordance with the relationship $$O_N \text{ equals } I_N \text{ or } Q_N \text{ or } Q_{N-1} \text{ or } S_N$$

where $O_N$ is said occupancy control signal, where $I_N$ is said occupancy indication signal, where $Q_{N-1}$ is said first protection signal, where $S_N$ is said second protection signal and with $Q_N$ being another protection signal which can be provided in response to another occupancy indication signal in relation to a signal block ahead of said first signal block N.

5. The apparatus of claim 1, with said occupancy control signal being operative with a second signal block adjacent to said first signal block for protecting said one train vehicle in relation to movement of a second train vehicle following behind said one train vehicle.

6. The apparatus of claim 1, with said first protection signal being operative with a third signal block previous to said second signal block to determine a vehicle speed code for said third signal block and with said selected one of said first and second protection signals being operative with said second signal block to determine a vehicle speed code for said second signal block.

7. The apparatus of claim 1, with said first protection signal being reset in accordance with the relationship $RQ_N$ equals $\overline{Q}_{N-1}$ and $Q_{N+1}$ . . . and $Q_{N+X}$ where X has a value such that the known total length of the involved series of signal blocks is selected to be greater than the predetermined maximum length train of vehicles, where $\overline{Q}_{N-1}$ is the logical not of the protection signal provided in relation to a train vehicle occupancy in previous signal block N − 1, where $Q_{N+1}$ is the protection signal provided in relation to a train vehicle occupancy in signal block N+2 ahead of signal block N and up to $Q_{N-X}$, which is the last of said involved series of signal blocks.

8. The apparatus of claim 1, including means establishing a predetermined track plan in accordance with the physical arrangement of signal blocks through which the speed of said plurality of train vehicles along said track is to be controlled, and with said means for providing an occupancy control signal being operative with said track plan establishing means for selecting one of said first and second protection signals in relation to said first signal block.

9. The apparatus of claim 8, with said track plan establishing means being operative to enable the tracking of a train vehicle passing along said track through a plurality of successive signal blocks.

10. The apparatus of claim 8 operative with a source of door open control signal when said one train vehicle is positioned within a station platform signal block, with said track plan establishing means being operative with said door open control signal for selecting said second protection signal in relation to said first signal block.

11. The apparatus of claim 1 with said first signal block being in a main track and being located in relation to a merge side track and operative with train vehicle control apparatus, and including means establishing a predetermined track plan in accordance with the physical arrangement of signal blocks including said first signal block through which the speed of said plurality of train vehicles along said track is to be controlled, and with said track plan establishing means being operative with said train vehicle control apparatus to provide said occupancy control signal for determining the operation of said train vehicle in relation to said merge side track.

12. In the method of controlling the movement of at least a second train vehicle following behind a first train vehicle along a track including a plurality of signal blocks, the steps of detecting an occupancy of a first signal block by said first train vehicle, providing a first predetermined occupancy protection of said first train vehicle in response to said detected occupancy, providing a second predetermined occupancy protection of said first train vehicle in response to said detected occupancy, and providing occupancy control of said first train vehicle in response to a selected one of said first predetermined occupancy protection and said second predetermined occupancy protection of said first train vehicle.

13. The method of claim 12, including the step of providing a predetermined track plan in accordance with the physical characteristics of the signal blocks through which the speed of said plurality of train vehicles along said track is to be controlled and operative to select one of said first predetermined occupancy protection and said second predetermined occupancy protection of said first train vehicle.

14. The method of claim 12, with said occupancy control of said first signal block being provided in accordance with the relationship $$O_N \text{ equals } I_N \text{ or } Q_N \text{ or } Q_{N-1} \text{ or } S_N$$

where $O_N$ is said provided occupancy control, where $I_N$ is said detected occupancy, where $Q_{N-1}$ is said first predetermined occupancy protection, where $S_N$ is said second predetermined occupancy protection and where $Q_N$ is a predetermined occupancy protection that can be provided in relation to the occupancy of an additional signal block N+1 ahead of said first signal block N.

15. The method of claim 12, with said step of providing occupancy control being in relation to at least a second signal block adjacent to said first signal block.

16. The method of claim 12, including the step of providing a third predetermined occupancy protection of said first train vehicle, with said occupancy control being provided in response to said third predetermined occupancy protection.

17. The method of claim 16, with said step of providing occupancy control being in relation to a second signal block adjacent to said first signal block.

18. The method of claim 12, with said step of providing occupancy control being operative to protect against loss of said detected occupancy of the first signal block.

19. The method of claim 12, with one of said first occupancy protection and said second occupancy protection not being operative to force protection in a forward direction of said first train vehicle.

20. The method of claim 12, with said provided occupancy control being operative to control the movement of at least said second train vehicle in relation to a second signal block adjacent to said first signal block.

* * * * *